US007648048B2

(12) United States Patent
Smith

(10) Patent No.: US 7,648,048 B2
(45) Date of Patent: Jan. 19, 2010

(54) COMBINATION SHIPPING CONTAINER AND DISPENSER

(75) Inventor: Tracy C. Smith, Stone Mountain, GA (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 0 days.

(21) Appl. No.: 12/193,903

(22) Filed: Aug. 19, 2008

(65) Prior Publication Data

US 2008/0302864 A1 Dec. 11, 2008

Related U.S. Application Data

(62) Division of application No. 11/143,697, filed on Jun. 2, 2005.

(60) Provisional application No. 60/578,132, filed on Jun. 9, 2004, provisional application No. 60/641,443, filed on Jan. 6, 2005.

(51) Int. Cl.
*A47F 1/04* (2006.01)
*B65D 5/72* (2006.01)

(52) U.S. Cl. ..... 221/305; 221/302; 221/303; 221/306; 229/121; 229/122; 229/122.1; 229/123.2; 229/123.3

(58) Field of Classification Search ..... 229/121, 229/122, 122.1, 122.2, 123.2, 123.3, 101.1; 221/305, 302, 303, 306
See application file for complete search history.

(56) References Cited

U.S. PATENT DOCUMENTS 3,137,437 A * 6/1964 Svensson ..... 229/101.1
3,263,861 A 8/1966 Carr
3,300,115 A 1/1967 Schauer
3,332,594 A 7/1967 De Capua
3,356,279 A 12/1967 Root
3,416,719 A 12/1968 Pilger
4,396,143 A 8/1983 Killy
4,974,771 A 12/1990 Lavery
5,505,372 A * 4/1996 Edson et al. ..... 229/121
5,813,597 A 9/1998 Wakevainen
6,253,930 B1 7/2001 Freidus et al.
6,283,293 B1 9/2001 Lingamfelter
6,478,219 B1 11/2002 Holley, Jr.
6,484,903 B2 11/2002 Spivey et al.
6,550,615 B2 4/2003 Lingamfelter (Continued)

FOREIGN PATENT DOCUMENTS

CA 874824 A 7/1971

(Continued)

OTHER PUBLICATIONS

European Search Report for EP 05012377.7, EPO, mailing date: Oct. 10, 2005, Munich, Germany.

(Continued)

*Primary Examiner*—Gene Crawford
*Assistant Examiner*—Michael K Collins
(74) *Attorney, Agent, or Firm*—Joel T. Charlton

(57) ABSTRACT

A combination shipping container and dispenser is described herein. A regular slotted container (RSC) is modified to include at least a first and second dispensing feature such that the RSC can dispense product when it is configured in either a horizontal or in a vertical orientation.

3 Claims, 19 Drawing Sheets

U.S. PATENT DOCUMENTS

| | | | | |
|---|---|---|---|---|
| 6,578,736 | B2 | 6/2003 | Spivey | |
| 6,715,639 | B2 | 4/2004 | Spivey | |
| 6,789,673 | B2 | 9/2004 | Lingamfelter | |
| 6,866,185 | B2 | 3/2005 | Harrelson | |
| 6,866,188 | B2 * | 3/2005 | Harrelson | 229/121 |
| 6,902,104 | B2 | 6/2005 | Holley et al. | |
| 6,929,172 | B2 | 8/2005 | Bates et al. | |
| 6,974,072 | B2 | 12/2005 | Harrelson | |
| 7,000,824 | B2 | 2/2006 | Saulas | |
| 7,004,897 | B2 | 2/2006 | Spivey | |
| 7,021,468 | B2 | 4/2006 | Cargile | |
| 7,104,435 | B2 | 9/2006 | Holley | |
| 7,134,593 | B2 | 11/2006 | Harrelson | |
| 7,147,143 | B2 | 12/2006 | Cargile | |
| 7,237,674 | B2 | 7/2007 | Auclair | |
| 7,306,135 | B2 * | 12/2007 | DeBusk et al. | 229/101.1 |
| 7,328,798 | B2 * | 2/2008 | Auclair et al. | 206/427 |
| 7,475,777 | B2 * | 1/2009 | Fung et al. | 206/427 |
| 2002/0070139 | A1 | 6/2002 | Bates | |
| 2003/0141313 | A1 | 7/2003 | Bates | |
| 2003/0146270 | A1 | 8/2003 | Caille et al. | |
| 2003/0192907 | A1 | 10/2003 | Bates | |
| 2004/0040877 | A1 | 3/2004 | Lingamfelter | |
| 2004/0074954 | A1 | 4/2004 | Fogle et al. | |
| 2004/0159671 | A1 | 8/2004 | Spivey | |
| 2004/0164133 | A1 | 8/2004 | Harrelson | |
| 2005/0056658 | A1 | 3/2005 | Spivey | |
| 2005/0139501 | A1 | 6/2005 | Lingamfelter | |
| 2005/0199688 | A1 | 9/2005 | Fogle et al. | |
| 2005/0242165 | A1 | 11/2005 | Cargile | |
| 2006/0175386 | A1 | 8/2006 | Holley | |
| 2006/0249529 | A1 * | 11/2006 | Smalley et al. | 221/305 |

FOREIGN PATENT DOCUMENTS

| | | |
|---|---|---|
| CA | 874828 | 7/1971 |
| GB | 755009 | 8/1956 |
| GB | 755099 A | 8/1956 |
| WO | 02/04302 A1 | 1/2002 |

OTHER PUBLICATIONS

Abstract for GB755009; Publication Date: Aug. 15, 1956; "Improvements in or relating to photographic flash lamp packages";.

* cited by examiner

COMBINATION SHIPPING CONTAINER AND DISPENSER

This application claims the benefit of U.S. patent application Ser. No. 11/143,697, filed Jun. 2, 2005, which claims the benefit of U.S. Provisional Application No. 60/578,132, filed Jun. 9, 2004 and U.S. Provisional Application No. 60/641,443, filed Jan. 6, 2005.

BACKGROUND OF THE INVENTION

The invention relates to packaging for shipping and dispensing products. More particularly, the invention relates to packaging for dispensing cylindrical product, preferably core paper based items such as paper towels and toilet tissue, in a combination shipping and dispensing container.

Manufacturers typically ship products, especially paper products or products packaged in small boxes, in light weight cardboard containers, known as regular slotted containers (RSCs). These are very common, and a visit to almost any retail store indicates how ubiquitous these containers are. RSCs are manufactured from many different types of paperboard materials, each with their own load carrying characteristics. Additionally, these RSCs can be printed with decorative printing, operating as advertisement for the products contained within.

The end users of RSCs, the store owners, desire to maximize usage of their floor and storage space. Storage space is valuable real estate that does not directly earn the store owner money. While having excess inventory on hand can be important, especially if demand is high, all the product stored in storage areas represents an investment in money by the store owner. This inventory is typically not immediately available to the consumer to provide sales opportunities to the store owner. Indeed such excess inventory can actually cause the store owner to incur additional cost to store the inventory and then move the merchandise from the storage area and onto the floor where consumers can encounter it. Therefore, store owners have taken to storing product on the floor in their original RSCs to be immediately accessed by the consumer. For example, in some industries, there are free standing floor displays that utilize 15 count RSC designs. This means that the RSCs are stacked 15 units high. Unfortunately, presently available RSCs are not specifically designed to efficiently and effectively dispense the product they contain. The RSCs of the prior art must have their flaps opened, which does not present an aesthetically pleasing display for the consumer. These flaps or portions of the RSC can be cut-away with a knife to allow the product contained therein to be retrieved. Cutting away portions of the RSC may lead to loss of product through accidental knife-cutting damage to the product. The acts of opening closed flaps and cutting away portions of the RSC and the loss of product through damage are deficiencies that represent monetary losses to the store owner. It can even lead to future lost sales where consumers are not pleased with the shopping environment and begin to frequent other stores to purchase items shipped in such RSCs.

Other industries that use RSCs include the hotel industry and the commercial cleaning industry. In the hotel industry, there are small storage spaces, and the cleaning personnel must move products to multiple locations easily and without distraction. The same requirements apply to commercial restroom facility cleaners. The personnel whose task it is to clean restrooms need to get small carts in the restrooms to clean them while minimizing the possibility of dropping supplies on the floor. Similarly, it would be beneficial if personnel could store certain supplies in limited areas adjacent to the restrooms so that users of the restroom facilities could easily access certain products, without the hotel or commercial restroom facility owner having to pay the additional personnel costs to restock these items in the restrooms. Moving product in the original RSC, in both the hotel and cleaning industries, appears to save time and make the operation more efficient. This is somewhat deceiving because use of the prior art RSCs in this manner suffers some of the same deficiencies that those in the retail outlet industry experience, plus additional difficulties. For example, cleaning and hotel industry personnel will also open the RSC with a knife that can lead to product damage and waste. Furthermore, even if the product is not damaged, spillage from carts is possible with prior art RSCs as they are clumsy and inefficient in dispensing product. These deficiencies lead to inefficiencies in completing the tasks, leading to larger labor costs.

As an alternative to the RSC described above, another commonly used shipping/containment material is poly-propylene wrap (poly-wrap). Poly-wrap does not maintain its shape and integrity without the influence of the contained product. Therefore, after the poly-wrap material is opened and product is retrieved from the poly-wrap material, the poly-wrap material loses its ability to contain the product initially wrapped in the material making the product remaining in the poly-wrap material difficult to store and retrieve.

The foregoing problem with poly-wrap material is a problem that generally, though not exclusively, occurs to users in their home. Product such as paper towels and toilet tissue can be packaged in large quantities in poly-wrap material. This is a convenience and cost-savings for the consumer. However, it is difficult for consumers to store these large quantities of product in their home because of the shortcomings of the poly-wrap material noted above. After the first few products are removed from the poly-wrap material, the remaining products may spill out from the area where the consumer has stored the initial package requiring the consumer to remove all of the product from the poly-wrap material in order to maintain the storage area in some semblance of organization. At a minimum, the storage area can become unsightly and disorganized once the poly-wrap material loses its ability to adequately contain the product therein.

Therefore, there is a need to design an RSC, that allows a dispensing feature for use in homes, stores, the hotel industry, the commercial restroom facility cleaning industry and other locations and industries that does not suffer the deficiencies noted above.

BRIEF SUMMARY OF THE INVENTION

A combination shipping container and dispenser ("container") is provided having a top, a bottom, two end walls and two sets of closure flaps forming the sides of the container. Perforations formed in the container are provided to allow a consumer or other user to form a dispenser opening in the top of the container by removing the material of the container bounded by the perforations. In addition or alternatively, perforations may also be formed in the container to allow the consumer or other user to form another dispenser opening in one of the ends thereof. The dispenser openings formed in the top and one end preferably extend partially along the two sides of the container to facilitate the removal of the product stored therein. The provision of two sets of perforations gives the consumer or other user of the container flexibility in terms of the orientation that the container can be placed in a display area, storage area or other location while still allowing easy dispensing of the product therefrom. The material used to form the combination shipping container and dispenser can be any standard material such as corrugated paperboard that is typically used for packaging or shipping containers. This material provides enough rigidity to the combination shipping container and dispenser to allow it to maintain its shape and retain the product therein until the product is to be dispensed therefrom.

A blank for forming the combination shipping container and dispenser is also provided. The blank includes an adhesive tab, a bottom panel, a first end panel, a top panel and a second end panel. Adjoining the top and bottom of the bottom panel are a bottom panel top flap and a bottom panel bottom flap respectively. Adjoining the top and bottom of the first end panel are a first end panel top flap and a first end panel bottom flap respectively. Adjoining the top and bottom of the top panel are a top panel top flap and a top panel bottom flap respectively. Adjoining the top and bottom of the second end panel are a second end panel top flap and a second end panel bottom flap respectively. A generally rectangular perforation is formed in the first end panel and extends partially into the first end top flap and the first end bottom flap. In addition, another generally rectangular perforation may be formed in the top panel and extends partially into the top panel top flap and the top panel bottom flap.

BRIEF DESCRIPTION OF THE DRAWINGS

The various objects, advantages and novel features of the present invention will be best understood by reference to the detailed description of the preferred embodiments which follows, when read in conjunction with the accompanying drawings, in which.

DETAILED DESCRIPTION OF THE INVENTION

Figure 5:
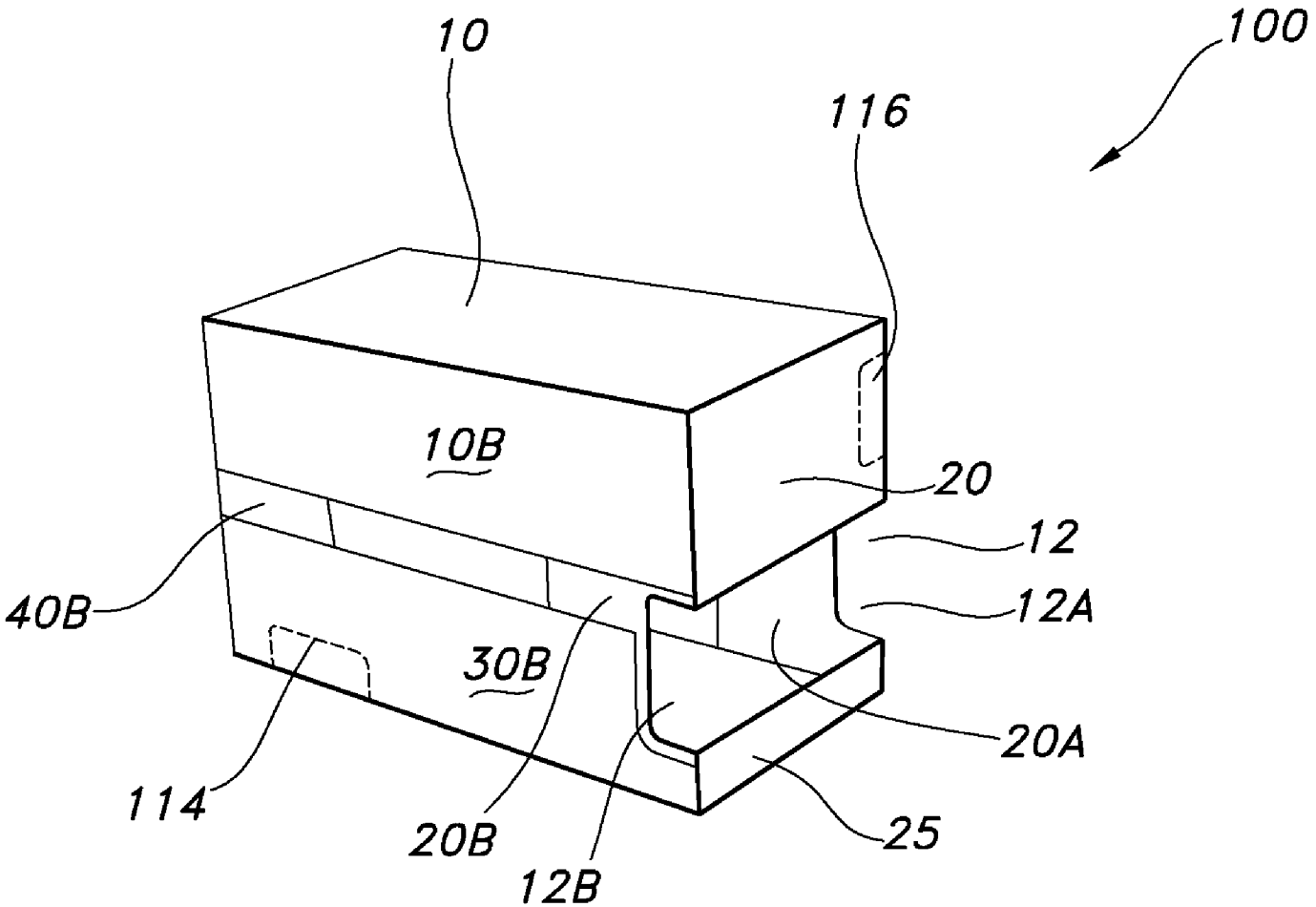
FIG. 5 is a perspective view of the combination shipping container and dispenser in a horizontal dispensing orientation wherein the dispenser opening is in an end panel.

Several embodiments of the present invention will now be described in detail with reference to the annexed drawings. In the drawings, the same elements are denoted by the same reference numerals even though they are depicted in different drawings and the same reference numerals followed by one or more (') denotes similar elements in the different drawings. As used herein, the term "top" refers to a location on the combination shipping container and dispenser of this invention along the upper surface thereof as seen in the orientation of FIG. 5. As used herein, the term "bottom" refers to a location on the combination shipping container and dispenser of this invention along the lower surface as seen in the orientation of FIG. 5. As used herein, the term "end" when used in reference to a position on the combination shipping container and dispenser of this invention refers to either the right most or left most side of the combination shipping container and dispenser as seen in the orientation of FIG. 5. In addition, although the embodiments of the invention described herein include both an end panel door and a top panel door, with all of the structure that is required for those doors, it is contemplated that the invention can include either one of the end panel door or the top panel door separately without departing from the spirit of the invention.

One of the advantages of the combination shipping container and dispenser (hereinafter sometimes referred to simply as the container) 100 of this invention is its unique ability to act as both a shipping container and dispenser for product 8 located therein. Such product 8 can include paper towels and toilet tissue, both at the retail and consumer level. A regular slotted container (RSC), which can be manufactured using conventional industry equipment, can be modified to include perforations 112 and 114 that define end panel dispenser opening 12 and top panel dispenser opening 14 respectively therein to form combination shipping container and dispenser 100. Preferably, perforations 112 and 114 are disposed in the top and one end of combination shipping container and dispenser 100. Although the preferred embodiment includes perforation 114 in the top of container 100, it is to be understood that perforation 114 could be included in the bottom of container 100. These perforations 112 and 114 allow combination shipping container and dispenser 100 to be transformed from a shipping unit into a merchandising/dispensing unit. The entire combination shipping container and dispenser 100 can be located on the shelf or the floor of a retail outlet for use as a modular display or can be stored at a consumer's home or office. There can also be optionally added mounting openings to combination shipping container and dispenser 100 so that a user, generally a consumer, can purchase product 8 in bulk in container 100 and hang it on hooks at home or in an office or workshop or any other area where product 8 is stored or needed. Product 8 can then be dispensed from either end panel dispenser opening 12, or top panel dispenser opening 14 as if it were on the ground or display table.

Figure 3:
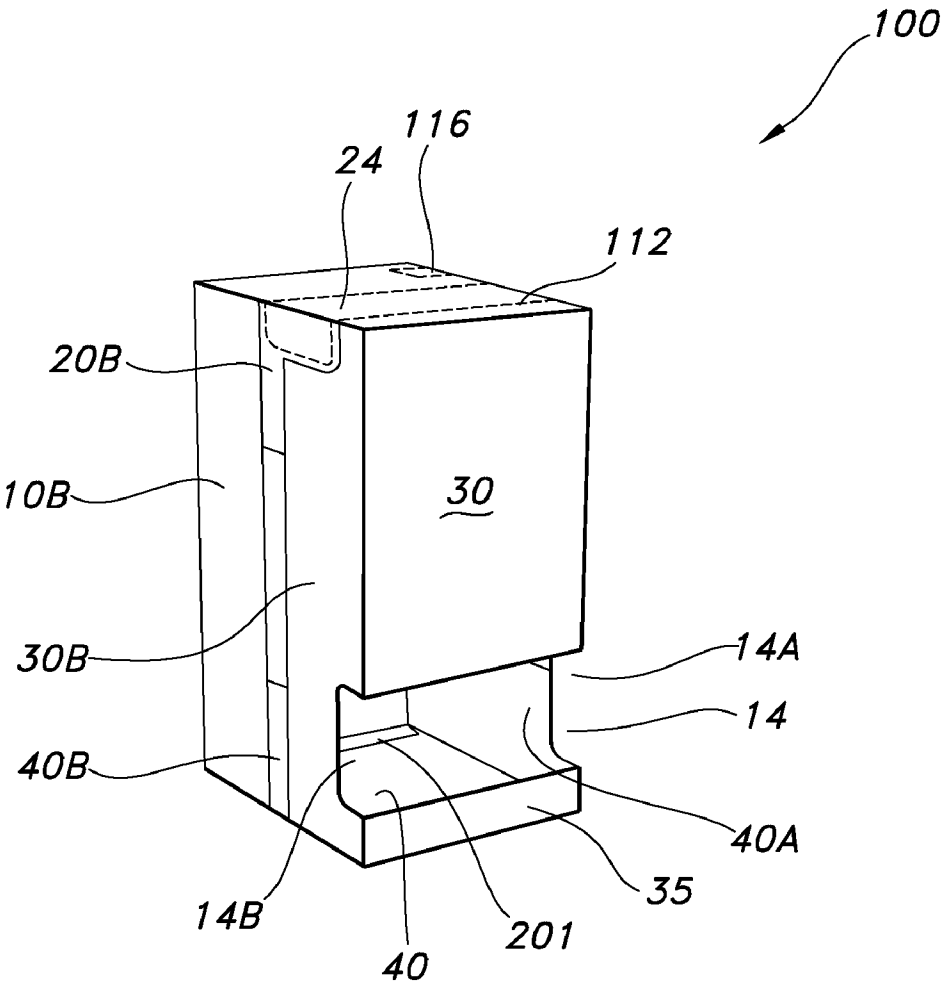
FIG. 3 is a perspective view of the combination shipping container and dispenser in a vertical dispensing orientation wherein the dispenser opening is in the top panel.

The location of end panel and top panel dispenser openings 12 and 14 as described allows combination shipping container and dispenser 100 to be placed in multiple orientations, i.e. in a generally vertical orientation, see FIG. 3, or a generally horizontal orientation, see FIG. 5, in order to utilize end panel dispenser opening 12 and/or top panel dispenser opening 14 when or if needed. If end panel and/or top panel dispenser openings 12, 14 are not required, i.e. during shipping, either or both of perforations 112, 114 can be left intact, i.e., not separated from combination shipping container and dispenser 100, so it can operate as a conventional regular slotted container to ship product contained therein. End panel and top panel dispenser openings 12, 14 do not compromise the structural integrity of container 100. A first end panel access opening, which is created by removing the material surrounded by perforation 116, and a second end panel access opening, which is created by removing the material surrounded by perforation 118, can be incorporated into both ends of container 100 to provide a location for a user to easily grab container 100 and thus assist a user in maneuvering and carrying combination shipping container and dispenser 100. All of these features, and others, will now be discussed in greater detail below.

Figure 1:
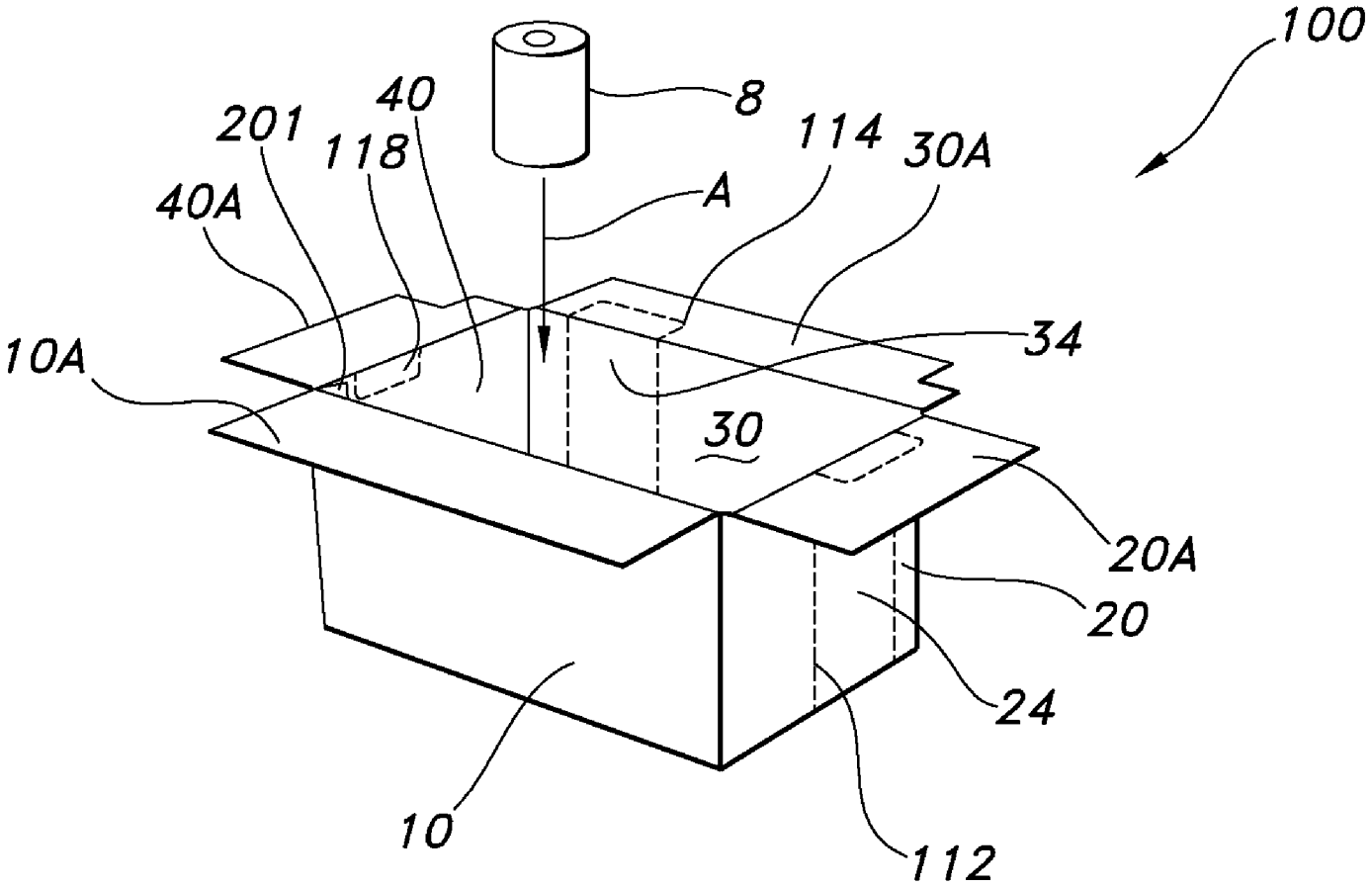
FIG. 1 is a perspective view of a combination shipping container and dispenser according to an embodiment of the present invention configured for product loading.

In FIG. 1, combination shipping container and dispenser 100 has the bottom panel top flap 10A, the first end panel top flap 20A, the top panel top flap 30A and the second end panel top flap 40A configured in an open position for product loading. While product 8 typically is a paper product wound around a cylindrical core (toilet paper, paper towel among others), other types of products can also be shipped in and dispensed from container 100. Preferably, product 8 is loaded along the axis of its core, as shown by arrow A, so that product 8 is vertical, as depicted in FIG. 1. This is the same loaded orientation as a product is typically loaded in a conventional RSC. Because product 8 has a paperboard cylindrical core, combination shipping container and dispenser 100, once filled with product 8, can withstand greater loads in the same vertical axis as the cylindrical cores than when combination shipping container and dispenser 100 is empty, or if product 8 were loaded horizontally. Therefore, because of this greater load bearing capacity, many combination shipping container and dispensers 100 can be stacked one on top of each other after they are loaded with product 8.

Figure 2:
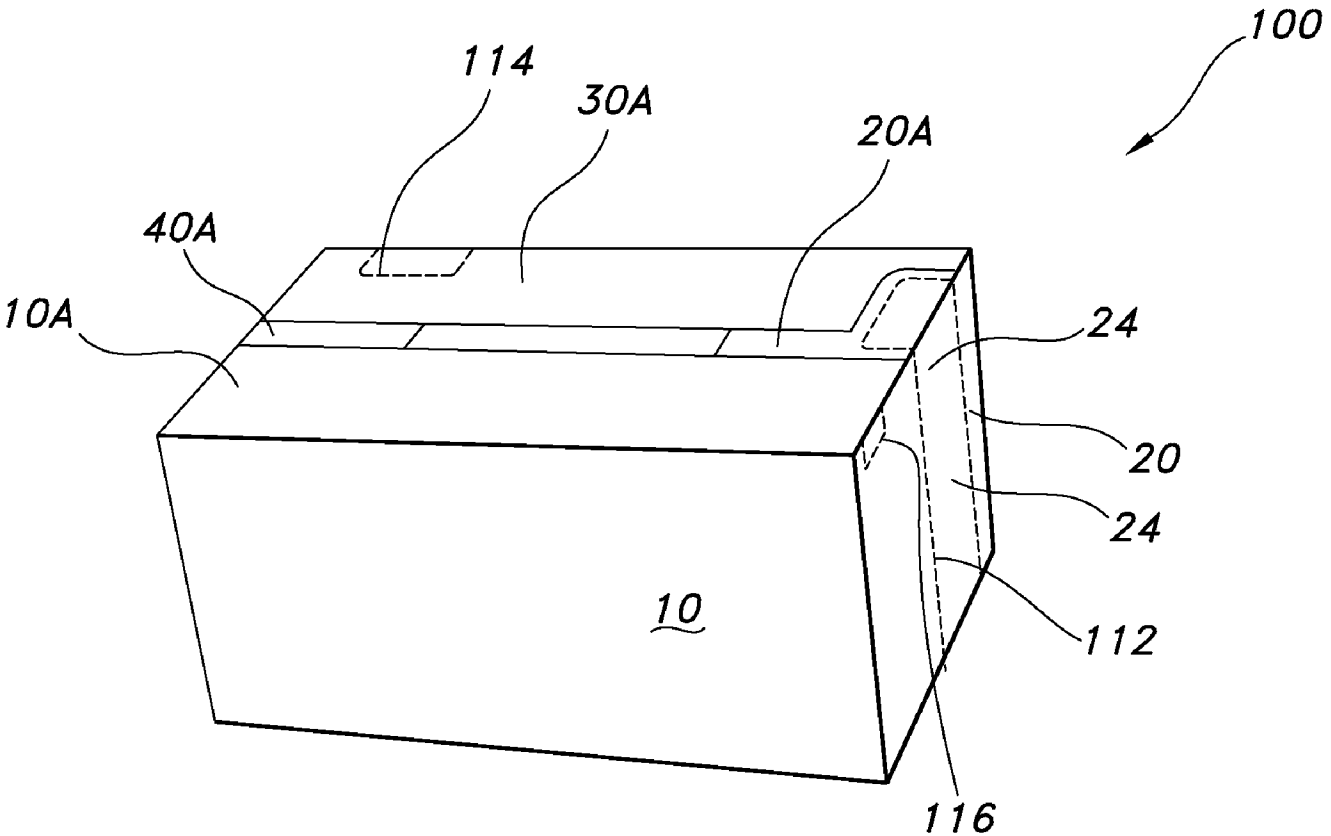
FIG. 2 is a perspective view of the combination shipping container and dispenser in a typical shipping orientation.

In FIG. 2 combination shipping container and dispenser 100 is shown in a typical shipping configuration with bottom panel top flap 10A, the first end panel top flap 20A, the top panel top flap 30A and the second end panel top flap 40A folded over, closed and sealed for shipping. Combination shipping container and dispenser 100 shown in the configuration of FIG. 2 does not have end panel dispenser opening 12 or top panel dispenser opening 14 exposed for access to product 8 therein since in this configuration combination shipping container and dispenser 100 is performing its shipping function. Perforations 112 and 114 are located in combination shipping container and dispenser 100 and can be used to tear away a portion of the paperboard material circumscribed by the perforation to provide access to product 8. Similarly, perforations 116 and 118 can be used to tear away a portion of the paperboard material circumscribed by the perforation to form the first end panel access opening and the second end panel access opening, which can be used to conveniently and easily move and carry combination shipping container and dispenser 100.

Figure 4B:
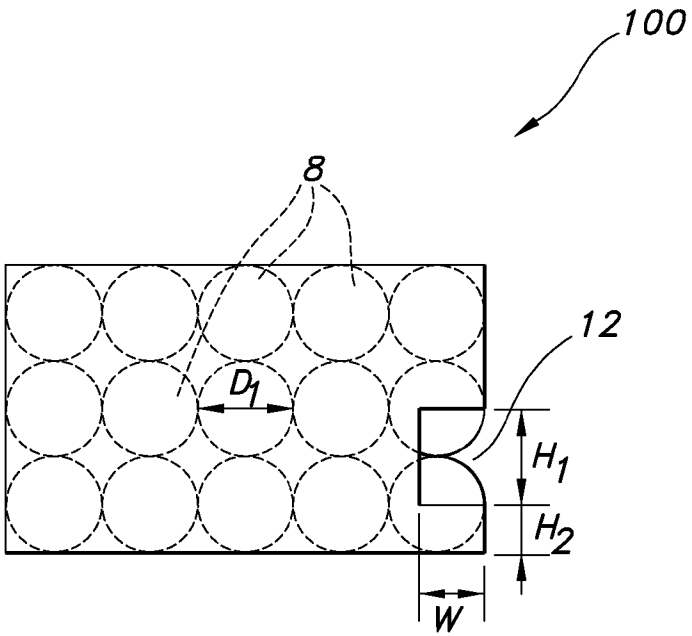
FIG. 4B is a side schematic view of the combination shipping container and dispenser in a horizontal dispensing orientation wherein the shipping container and dispenser is fully loaded with 15 pieces of product.
Figure 4A:
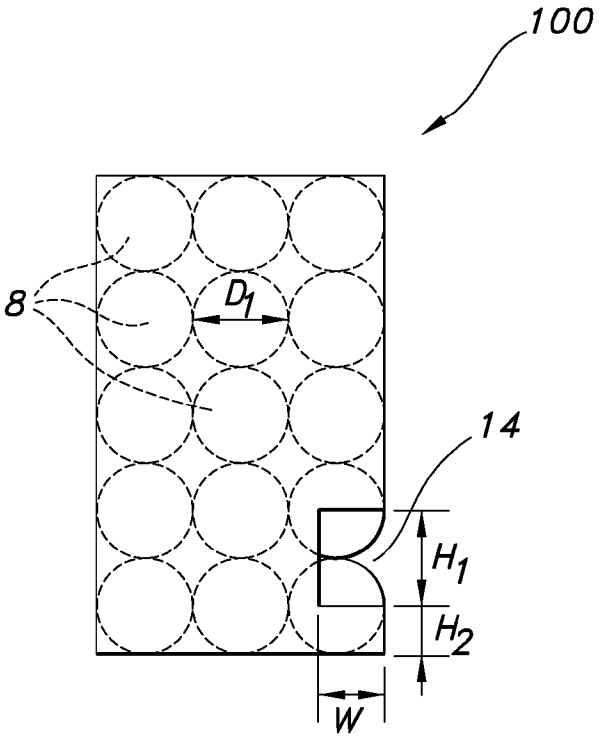
FIG. 4A is a side schematic view of the combination shipping container and dispenser in a vertical orientation wherein the combination shipping container and dispenser is fully loaded with 15 pieces of product.

FIG. 3 shows combination shipping container and dispenser 100 in a generally vertical dispensing orientation with top panel dispenser opening 14 facing forward. As shown in FIGS. 4A and 4B, combination shipping container and dispenser 100 can be fully loaded with 15 rolls of product 8. This is referred to as a 3×5 container (three rows of five units of product in each row). In another embodiment of the present invention, container 100 can also be configured to contain 12 rolls of a larger size of the product 8.

The relationship between the dimensions of end panel dispenser opening 12 and top panel dispenser opening 14, on the one hand, and product 8 being dispensed, on the other hand, should be such as to allow relatively easy removal of product 8 from combination shipping container and dispenser 100. If the cross sectional dimensions of a product that is shipped in combination shipping container and dispenser 100 do not appropriately match the dimensions of end panel dispenser opening 12 or top panel dispenser opening 14, then it is possible that the product may become stuck in container 100 or may not be easily removed therefrom. Preferably, the length L1 and the height H1 of end panel dispenser opening 12 and top panel dispenser opening 14 are at least slightly larger than the cross sectional dimensions of product 8 in its dispensed orientation. If product 8 is compressible, alternatively the length L1 and the height H1 of end panel dispenser opening 12 and top panel dispenser opening 14 can be slightly smaller than the cross sectional dimensions of product 8 in its dispensed orientation. Height H2, which is the height of the end panel containment lip 25 and top panel containment 35, should be sufficient to prevent product 8 from rolling out of combination shipping container and dispenser 100 when it is in its dispensing configuration. Preferably height H2 is in the range of about 0.25 to about 0.75 times the diameter D1 of product 8. More preferably height H2 is in the range of about 0.45 to about 0.55 times the diameter D1 of product 8. Even more preferably height H2 is about 0.5 times the diameter D1 of product 8. Preferably height H1, which is the height of end panel dispenser opening 12 and top panel dispenser opening 14, should be in the range of about 0.75 to about 1.25 times the diameter D1 of product 8. More preferably height H1 is in the range of about 0.95 to about 1.05 times the diameter D1 of product 8. Even more preferably height H1 is about the same as diameter D1. Even with this dimension for height H1, product 8 can be relatively easily removed from container 100 as long as product 8 is compressible to a certain extent. To assist in the removal of product 8, end panel and top panel dispenser openings 12, 14 also include wrap-around portions 12A, 12B and 14A, 14B respectively. First wrap around portion 12A for end panel dispenser opening 12 extends into first end panel top flap 20A and second wrap around portion 12B for end panel dispenser opening 12 extends into first end panel bottom flap 20B. Third wrap around portion 14A for top panel dispenser opening 14 extends into top panel top flap 30A. Fourth wrap around portion 14B for top panel dispenser opening 14 extends into top panel bottom flap 30B. The width W of wrap-around portions 12A, 12B, 14A and 14B are substantially the same and preferably are in the range of about 0.25 to about 0.75 times the diameter D1 of product 8. More preferably W is in the range of about 0.45 to about 0.55 times the diameter D1 of product 8. Even more preferably W is about one-half the diameter D1 of product 8. These dimensions for W allow the user to easily remove product 8 from combination shipping container and dispenser 100 because the user can grab the cylindrical core of product 8. Again, because product 8 is compressible, being made of paper products, it can be relatively easily removed from a combination shipping container and dispenser 100 that is fully loaded.

Figure 6:
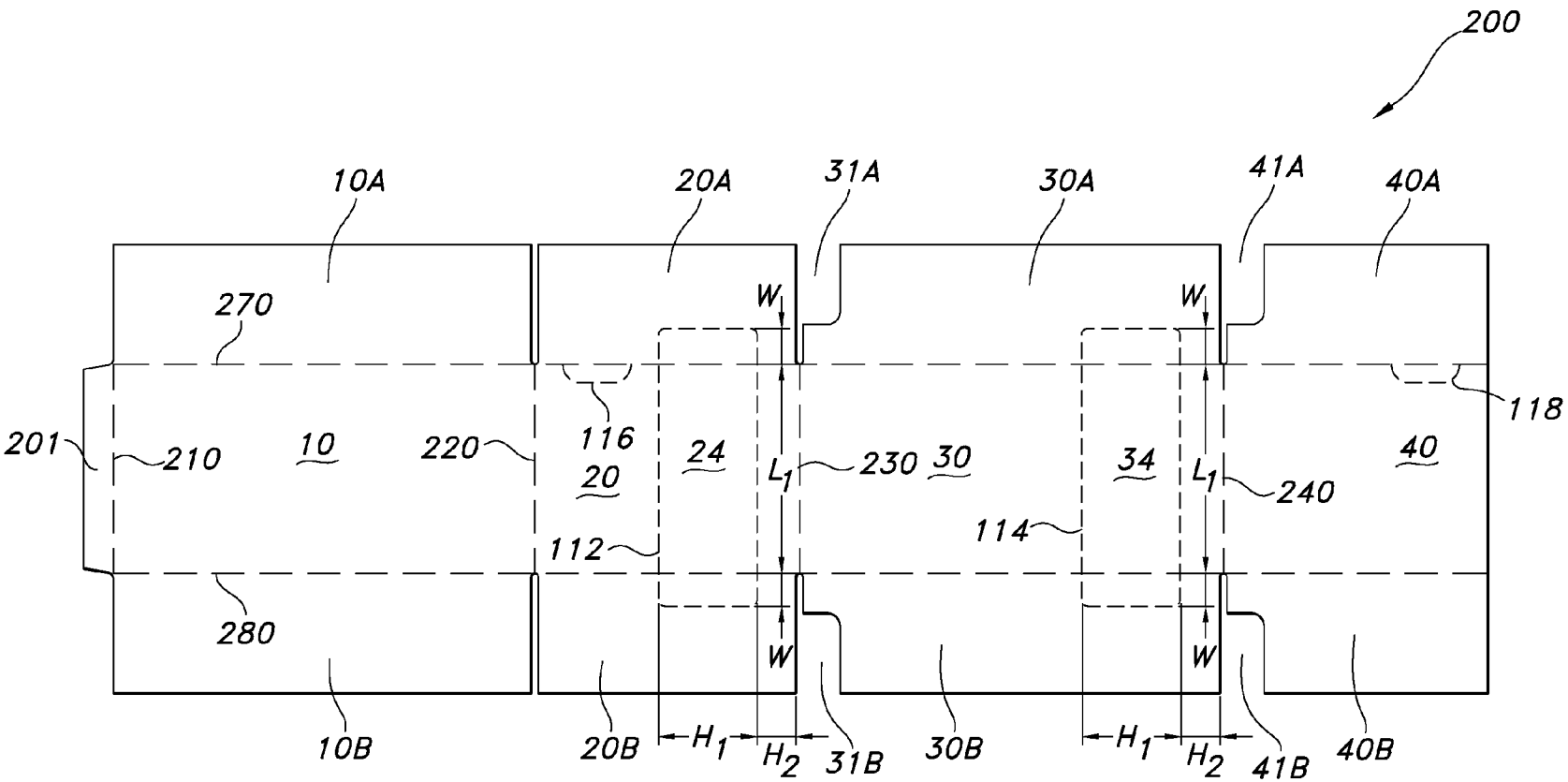
FIG. 6 is a plan view of a first paperboard blank that can be used to make the combination shipping container and dispenser.

A first paperboard blank 200 that can be used to make combination shipping container and dispenser 100 is shown in FIG. 6. Blank 200 includes four main panels, a bottom panel 10, a first end panel 20, a top panel 30 and a second end panel 40. Blank also includes an adhesive tab 201, which is connected along its right side to the left side of bottom panel 10 along a first vertical fold line 210. Bottom panel 10 is connected along its right side to the left side of first end panel 20 along a second vertical fold line 220. First end panel 20 is connected along its right side to the left side of top panel 30 along a third vertical fold line 230. Top panel 30 is connected along its right side to the left side of second end panel 40 along a fourth vertical fold line 240. Each of bottom panel 10, first end panel 20, top panel 30, and second end panel 40 includes a top flap defined above a first horizontal fold line 270 and a bottom flap defined below a second horizontal fold line 280. Bottom panel top flap 10A is adjacent to bottom panel 10 above first horizontal fold line 270 while bottom panel bottom flap 10B is adjacent to bottom panel 10 below second horizontal fold line 280. First end panel top flap 20A is adjacent to first end panel 20 above first horizontal fold line 270 while first end panel bottom flap 20B is adjacent to first end panel 20 below second horizontal fold line 280. Top panel top flap 30A is adjacent to top panel 30 above first horizontal fold line 270 while top panel bottom flap 30B is adjacent to top panel 30 below second horizontal fold line 280. Second end panel top flap 40A is adjacent to second end panel 40 above first horizontal fold line 270 while second end panel bottom flap 40B is adjacent to second end panel 40 below second horizontal fold line 280.

All of the top and bottom flaps, i.e. bottom panel top flap 10A, bottom panel bottom flap 10B, first end panel top flap 20A, first end panel bottom flap 20B, top panel top flap 30A, top panel bottom flap 30B, second end panel top flap 40A, and second end panel bottom flap 40B have substantially the same height. Bottom panel top flap 10A and bottom panel bottom flap 10B have substantially the same width. First end panel top flap 20A and first end panel bottom flap 20B also have substantially the same width. Note that notches 31A, 31B on top panel top flap 30A and top panel bottom flap 30B, respectively, are needed to avoid having top panel top flap 30A cover first wrap around portion 12A for end panel dispenser opening 12 and to avoid having top panel bottom flap 30B cover second wrap around portion 12B for end panel dispenser opening 12 when paperboard blank 200 is assembled into combination shipping container and dispenser 100. Similarly, notch 41A on second end panel top flap 40A prevents second end panel top flap 40A from covering third wrap around portion 14A and notch 41B on second end panel bottom flap 40B prevents it from covering fourth wrap around portion 14B. The width of notches 31A, 31B, 41A and 41B should be at least equal to or greater than height H2 and the length of notches 31A, 31B, 41A and 41B should be at least equal to or greater than height H1.

Perforation 112 is formed to create a generally rectangular shape that extends across first end panel 20 and into first end panel top flap 20A and first end panel bottom flap 20B. The area circumscribed by perforation 112 is end panel door 24. Preferably the right most side of perforation 112 is formed a distance H2 from third vertical fold line 230. The dimension H2 is defined above. Preferably, the width of the rectangle formed by perforation 112 is H1 as also defined above. Preferably, the portion of the rectangle defined by perforation 112 that extends into first end panel top flap 20A above first horizontal fold line 280 is defined by dimension W, which has also been defined above. Similarly the portion of the rectangle defined by perforation 112 that extends into first end panel bottom flap 20B below second horizontal fold line 280 is also defined by dimension W. Similarly perforation 114 is formed to create a generally rectangular shape that extends across top panel 30 and into top panel top flap 30A and top panel bottom flap 30B. The area circumscribed by perforation 114 is top panel door 34. Preferably the right most side of perforation 114 is formed a distance H2 from fourth vertical fold line 240. The dimension H2 is defined above. Preferably, the width of the rectangle formed by perforation 114 is H1 as also defined above. Preferably, the portion of the rectangle defined by perforation 114 that extends into top panel top flap 30A above first horizontal fold line 280 is defined by dimension W, which has also been defined above. Similarly, the portion of the rectangle defined by perforation 114 that extends into top panel bottom flap 30B below second horizontal fold line 280 is also defined by dimension W.

Perforation 116 is formed in first end panel 20 and is preferably adjacent to first horizontal fold line 270. Perforation 116 can form a generally rectangular or oval space by itself or in combination with a portion of first horizontal fold line 270. If perforation 116 forms a generally rectangular space by itself, the material circumscribed by perforation 116 can be completely removed from the paperboard material so that the first end access opening is completely unobstructed for receiving a user's hand. Where perforation 116 forms a generally rectangular space by itself, it can be located in other locations in first end panel 20. Alternatively, if perforation 116 only extends to first horizontal fold line 270, a flap will be formed where the material circumscribed by perforation 116 remains connected to the rest of the paperboard material along first horizontal fold line 270. Similarly, perforation 118 is formed in second end panel 40 and is preferably adjacent to first horizontal fold line 270. Perforation 118 can form a generally rectangular or oval space by itself or in combination with a portion of first horizontal fold line 270. If perforation 118 forms a generally rectangular space by itself, the material circumscribed by perforation 118 can be completely removed from the paperboard material so that the second end panel access opening is completely unobstructed for receiving a user's hand. Where perforation 118 forms a generally rectangular space by itself, it can be located in other locations in second end panel 40 but should be horizontally and vertically aligned with perforation 116 formed in first end panel 20 so that the first end panel access opening and the second end panel access opening are aligned in the resulting combination shipping container and dispenser 100 making it easier to manipulate. Alternatively, if perforation 118 only extends to first horizontal fold line 270, a flap will be formed where the material circumscribed by perforation 118 remains connected to the rest of the paperboard material along first horizontal fold line 270. Again, in this situation perforation 118 should be horizontally aligned with perforation 116 so that first end access panel opening 16 and second end panel access opening 18 are substantially aligned.

All perforations in paperboard blank 200 are formed by scoring the paperboard so it is cut about 50% into the outer side of the paperboard material. This 50% cut is a continuous cut that extends from the surface of the material down to a depth that is half of the thickness of the material. The 50% cut assures a clean tear at the surface that leaves a relatively pleasing appearance, particularly when the paperboard blank 200 is printed.

All of the fold lines, i.e. first vertical fold line 210, second vertical fold line 220, third vertical fold line 230, fourth vertical fold line 240, first horizontal fold line 270 and second horizontal fold line 280, are formed by crushing the paperboard material along the line to be folded to facilitate bending of the paperboard material to form the various panels.

To assemble combination shipping container and dispenser 100, blank 200 is first folded along first horizontal fold line 270 and second horizontal fold line 280 and then unfolded. Then the shape of combination shipping container and dispenser 100 is formed by bending the paperboard material along first vertical fold line 210, second vertical fold line 220, third vertical fold line 230 and fourth vertical fold line 240 so that each of the adjacent panels, i.e. bottom panel 10, first end panel 20, bottom panel 30, and second end panel 40, and adhesive tab 201 are generally perpendicular to each other. This will put adhesive tab 201 adjacent to second end panel 40 so that first vertical fold line 210 can be aligned with the right edge of second end panel 40. When in this position, adhesive tab 201 can be glued, stapled or otherwise adhered by conventional means to second end panel 40 to form a box configuration that is open on both the top and bottom. Thereafter, bottom panel bottom flap 10B, first end panel bottom flap 20B, top panel bottom flap 30B and second end panel bottom flap 40B are folded inward toward the interior of the resulting combination shipping container and dispenser 100 so that each flap is generally perpendicular to its respective panel. Preferably, first end panel bottom flap 20A and second end panel bottom flap 40A are folded first and then bottom panel bottom flap 10B and top panel bottom flap 30B are folded second so that bottom panel bottom flap 10B and top panel bottom flap 30B are on the outside of combination shipping container and dispenser 100. These bottom flaps are glued, stapled or otherwise adhered to each other by standard fastening means. Combination shipping container and dispenser 100 is now ready to be filled with product 8, after which the top flaps are folded over and sealed in a manner analogous to the bottom flaps so that bottom panel top flap 10A and top panel top flap 30A are on the outside. Thereafter, combination shipping container and dispenser 100 can be shipped to its ultimate retail destination.

Figure 7B:
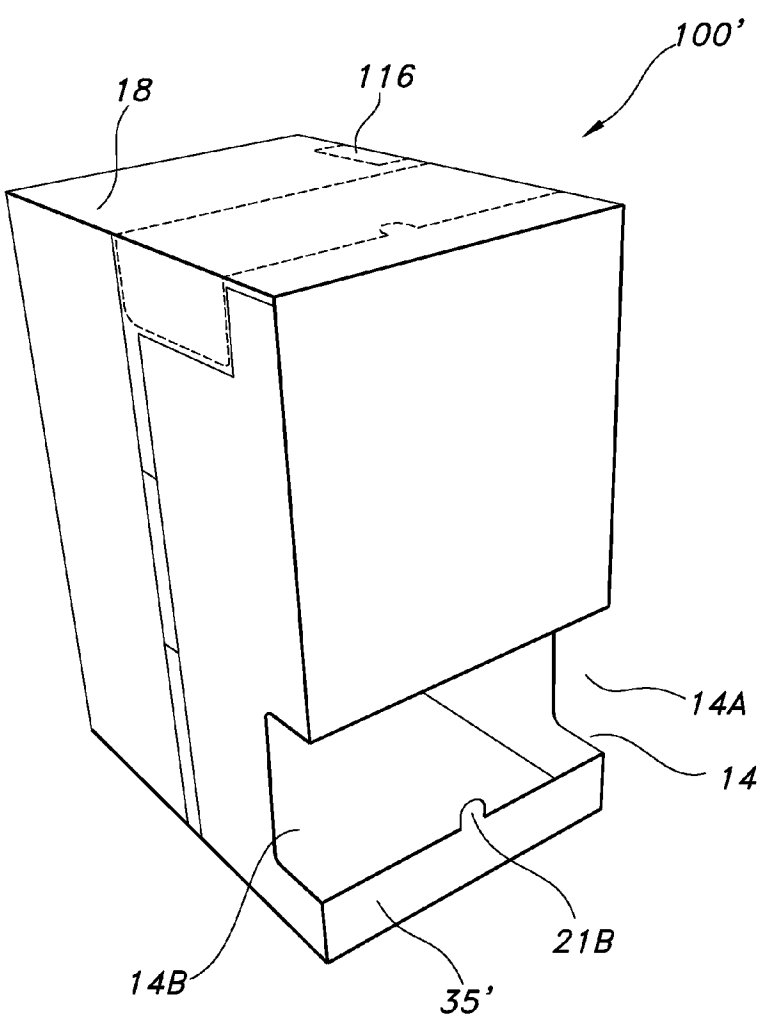
FIG. 7B is a perspective view of a second embodiment of the combination shipping container and dispenser in a vertical dispensing orientation with the dispenser opening in the top panel.
Figure 7A:
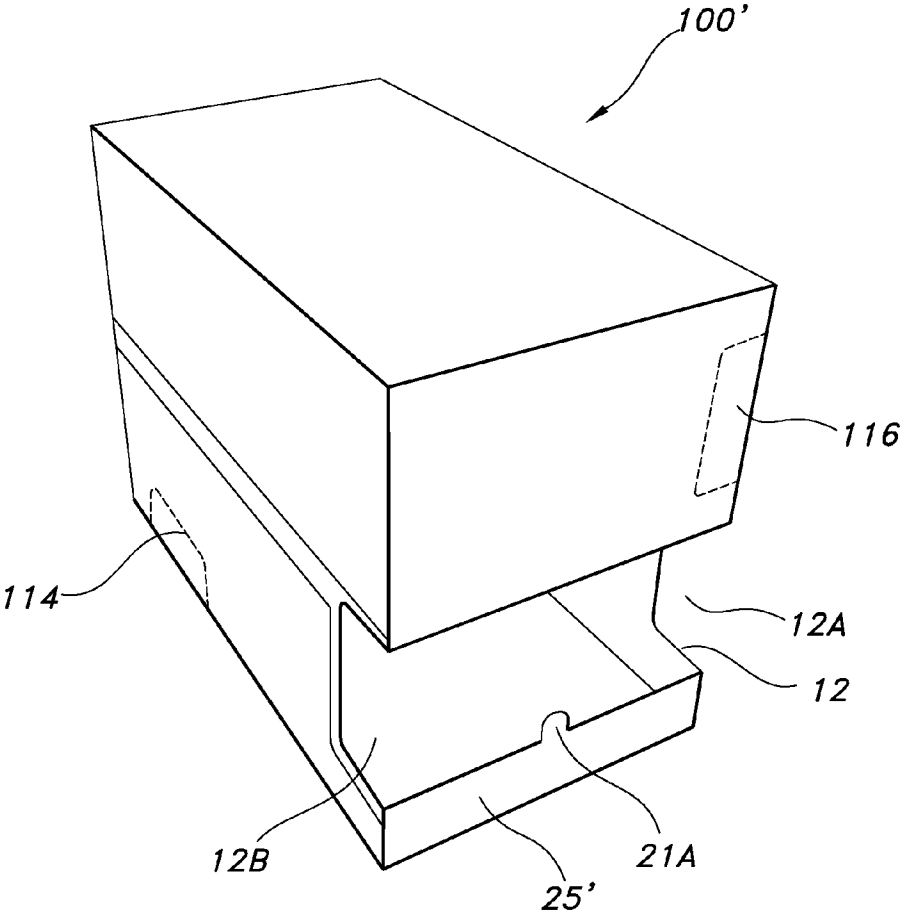
FIG. 7A is a perspective view of a second embodiment of the combination shipping container and dispenser in a horizontal dispensing orientation with the dispenser opening in an end panel.

A second embodiment of combination shipping container and dispenser 100', as shown in FIGS. 7A and 7B, includes an upstanding tab 21A and 21B located at about the midpoint of the bottom of end panel dispenser opening 12 and top panel dispenser opening 14, respectively. Such a tab acts to restrain smaller product that may be shipped in and dispensed from combination shipping container and dispenser 100' and prevent them from being prematurely dispensed therefrom. Tabs 21A and 21B are especially useful where combination shipping container and dispenser 100' is used to ship and dispense rolls of toilet tissue, which are smaller than rolls of paper towel.

Figure 8:
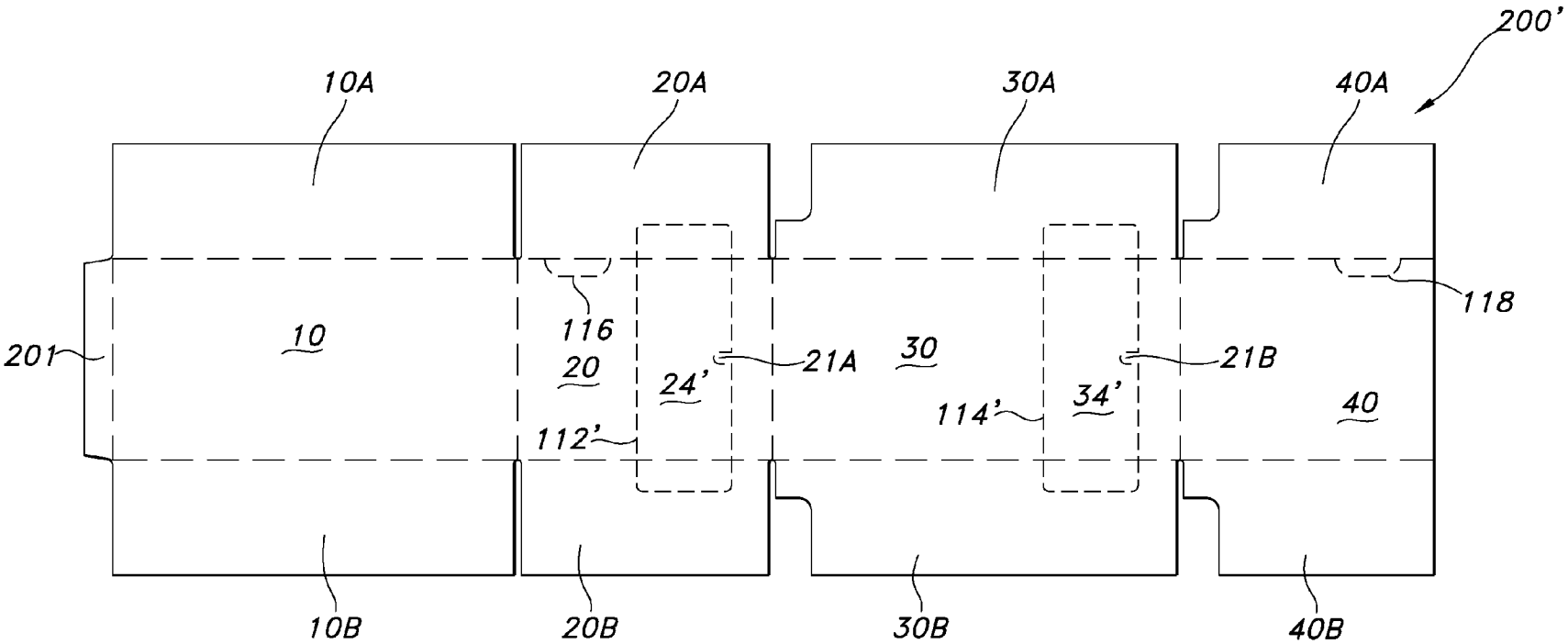
FIG. 8 is a plan view of a second paperboard blank that can be used to make the combination shipping container and dispenser of FIGS. 7A and 7B.
Figure 9:
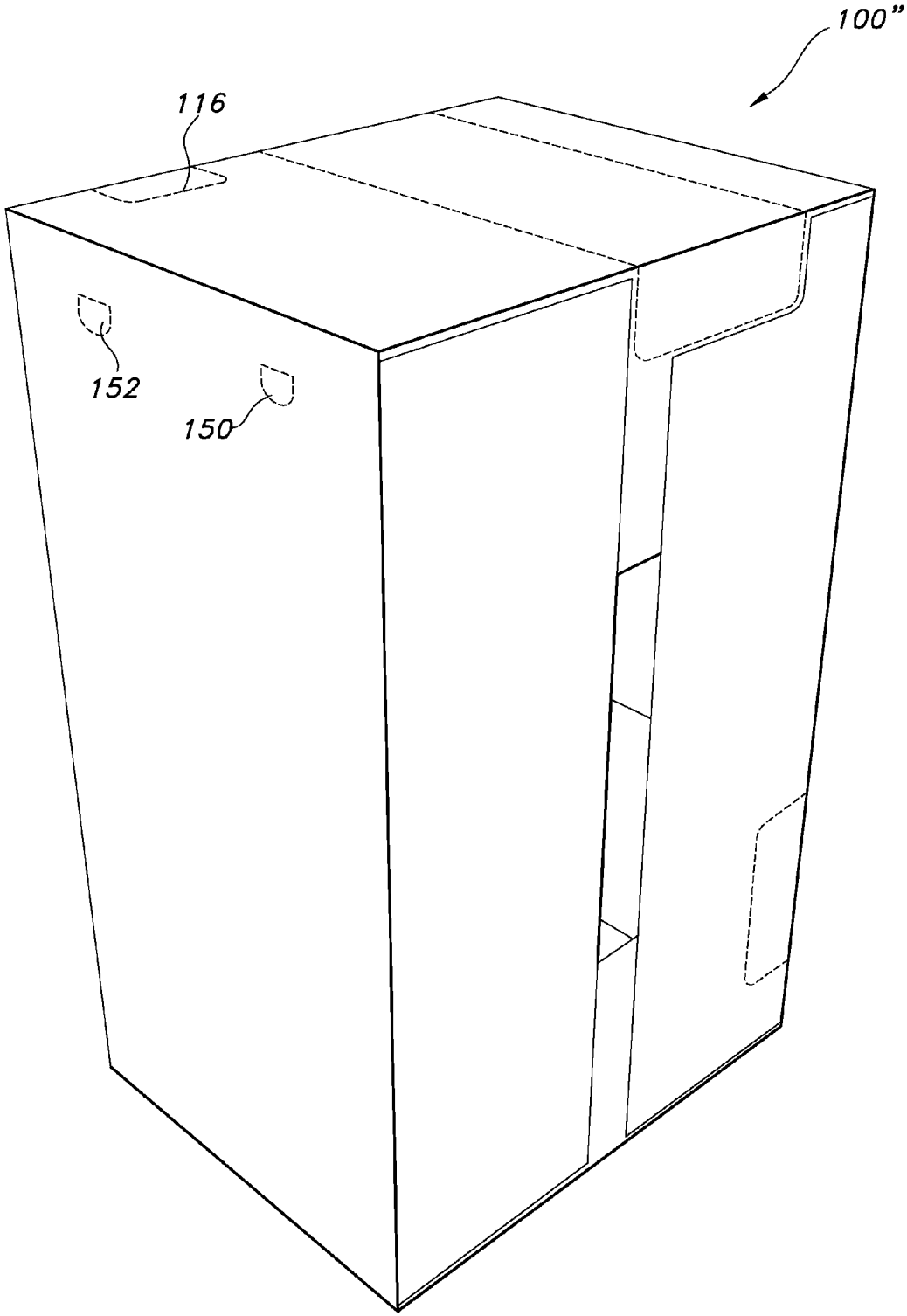
FIG. 9 is a perspective view of an embodiment of the combination shipping container and dispenser with a plurality of mounting openings therein.

The paperboard blank 200' used for making combination shipping container and dispenser 100' is shown in FIG. 8. Paperboard blank 200' is substantially identical to paperboard blank 200 shown in FIG. 6, except for the shape of perforation 112' and perforation 114'. As seen in FIG. 8, the right side of perforations 112' and 114' define a leftwardly extending tab 21A and 21B, respectively, that remains on combination shipping container and dispenser 100' after the material circumscribed by perforations 112' and 114' has been removed from the paperboard material. As noted above, tabs 21A and 21B are used to keep the rolls of toilet paper product separate and prevent them from being dispensed prematurely from combination shipping container and dispenser 100' once end dispenser opening 12 and top dispenser opening 14 have been created therein.

The combination shipping container and dispenser of this invention may also include additional openings or holes therein, which are formed by tearing away perforations 150 and 152, to allow the combination shipping container and dispenser of this invention to be hung from a hook, hangar or other device extending from a wall. For example, the user can use hooks found at hardware stores, grocery stores or other outlets that can be attached to the walls at home in their pantry, basement or other location to hang combination shipping container and dispenser 100" from the wall. Once container 100" is empty, it can be easily removed from the wall and replaced with another combination shipping container and dispenser 100" while the old one can be discarded, preferably recycled, or used for other purposes. Use of the first and second mounting openings provides the advantage of saving space, which can be very useful for consumers that live in a small home or apartment. Although it is conceivable for the mounting openings to be formed in second end panel 40 so that combination shipping container and dispenser 100" would extend from the wall in a horizontal dispensing orientation, preferably the mounting openings are located in bottom panel 10 in proximity to first end panel 20. This will allow combination shipping container and dispenser 100" to be hung from the wall in a vertical dispensing orientation so that product 8 can be dispensed from top panel dispenser opening 14.

Figure 10:
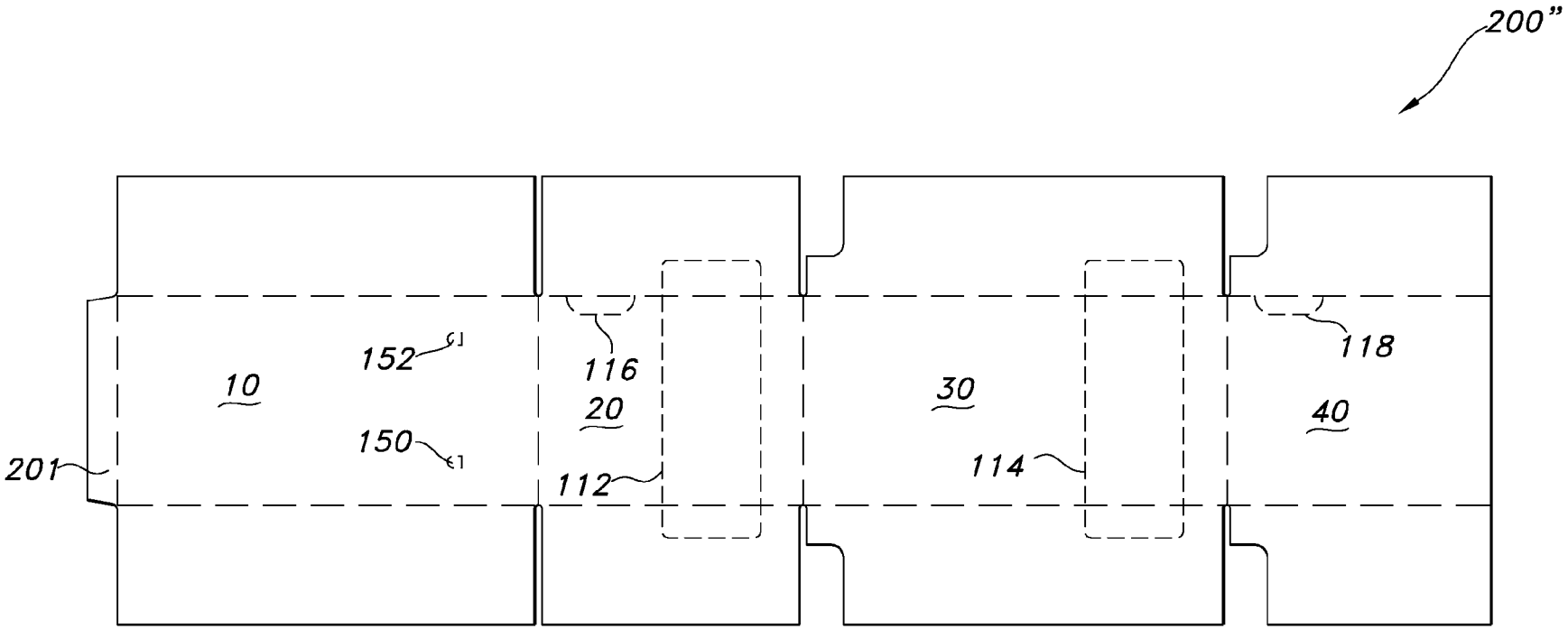
FIG. 10 is a plan view of a third paperboard blank that can be used to make the combination shipping container and dispenser of FIG. 9.

Paperboard blank 200" is substantially identical to paperboard blank 200 except for the addition of additional perforations 150, 152 formed in bottom panel 10. As seen in FIG. 10, perforations 150, 152 and thus the resulting mounting openings, should be vertically aligned so when container 100" is assembled the mounting holes will be horizontally aligned when container 100" is in a vertical dispensing orientation. Preferably perforations 150 and 152 should be in proximity to second vertical fold line 220. Perforations 150 and 152 can extend in a completely closed geometrical figure, e.g. a circle, to allow the user to completely punch out all of the material circumscribed by perforations 150 and 152. Alternatively, perforations 150 and 152 may not completely circumscribe an area to allow the material circumscribed by perforations 150 and 152 to remain attached to the rest of bottom panel 10 so that this material can be folded back out of the way, either into or out of combination shipping container and dispenser 100" to allow access to mounting openings 50 and 52.

Another embodiment of the combination shipping container and dispenser of this invention may include a hinged end panel door 24'" and an end panel hinged door portion 26 connecting hinged end panel door 24'" to end panel 20'" and a hinged top panel door 34''' and a top panel hinged door portion 36 connecting hinged top panel door 34''' to top panel 30. See FIGS. 12 and 13. The hinged end panel door 24''' and hinged top panel door 34''' allow end panel dispenser opening 12''' and top panel dispenser opening 14''' to be closed when desired. Hinged door portions 26 and 36 are primarily useful to provide extra space in end panel dispenser opening 12''' and top panel dispenser opening 14''' to dispense the product when the product is not compressible, such as when paper towel or toilet tissue is tightly wound making it less pliable, which would adversely affect the user's ability to squeeze the product through end panel dispenser opening 12''' and/or top panel dispenser opening 14'''. Hinged door portions 26 and 36 can also be effective when a commercial grade of rolled paper product that is not embossed is stored in and dispensed from container 100'''. Embossing normally adds a bit of "fluffiness" to make the product more flexible. Thus when the product is not embossed it may be more difficult to pull the product out of end dispenser opening 12''' and/or top dispenser opening 14'''. In addition, end panel hinged door portion 26 and top panel hinged door portion 36 provide a small amount of resistance against the product that is gravity fed from a higher vertical location in the combination shipping container and dispenser of this invention to a lower vertical location in order to prevent any dispensing that can prematurely occur accidentally after some product has been dispensed.

End panel dispenser opening 12''' and top panel dispenser opening 14''' also each include locking tabs. First and second end panel locking tabs 22A, 22B are located in end dispenser opening 12 and extend from first end panel top flap 20A''' and first end panel bottom flap 20B'''. First and second top panel locking tabs 32A, 32B are located in top panel dispenser opening 14 extending from top panel top flap 30A''' and top panel bottom flap 30B'''. Corresponding notches 23A, 23B, 33A, 33B are formed in either end of end panel door 24''' and top panel door 34'''. See FIGS. 12-14. The purpose of locking tabs 22A, 22B, 32A, 32B is to cooperate with notches 23A, 23B, 33A, 33B to hold end panel door 24''' and top panel door 34''' in place after they have been opened to provide a more aesthetically pleasing appearance and also to prevent inadvertent dispensing of product from combination shipping container and dispenser 100'''. Because locking tabs 22A, 22B, 32A and 32B are formed by a perforation they also provide a starting point for a user to tear the paperboard material along perforations 112''' and 114''' to form end panel dispenser opening 12''' and top panel dispenser opening 14'''.

If desired, end panel door 24''' can be detached from end panel hinged door portion 26 and top panel door 34''' can be detached from top panel hinged door portion 36 to leave end panel dispenser opening 12''' and top panel dispenser opening 14''', respectively, uncovered. In that case, there may be no need for locking tabs 22A, 22B, 32A, and 32B, although it may be desirable to include these locking tabs to facilitate tearing of the paperboard material along perforations 112''' and 114''' as noted above.

Figure 11:
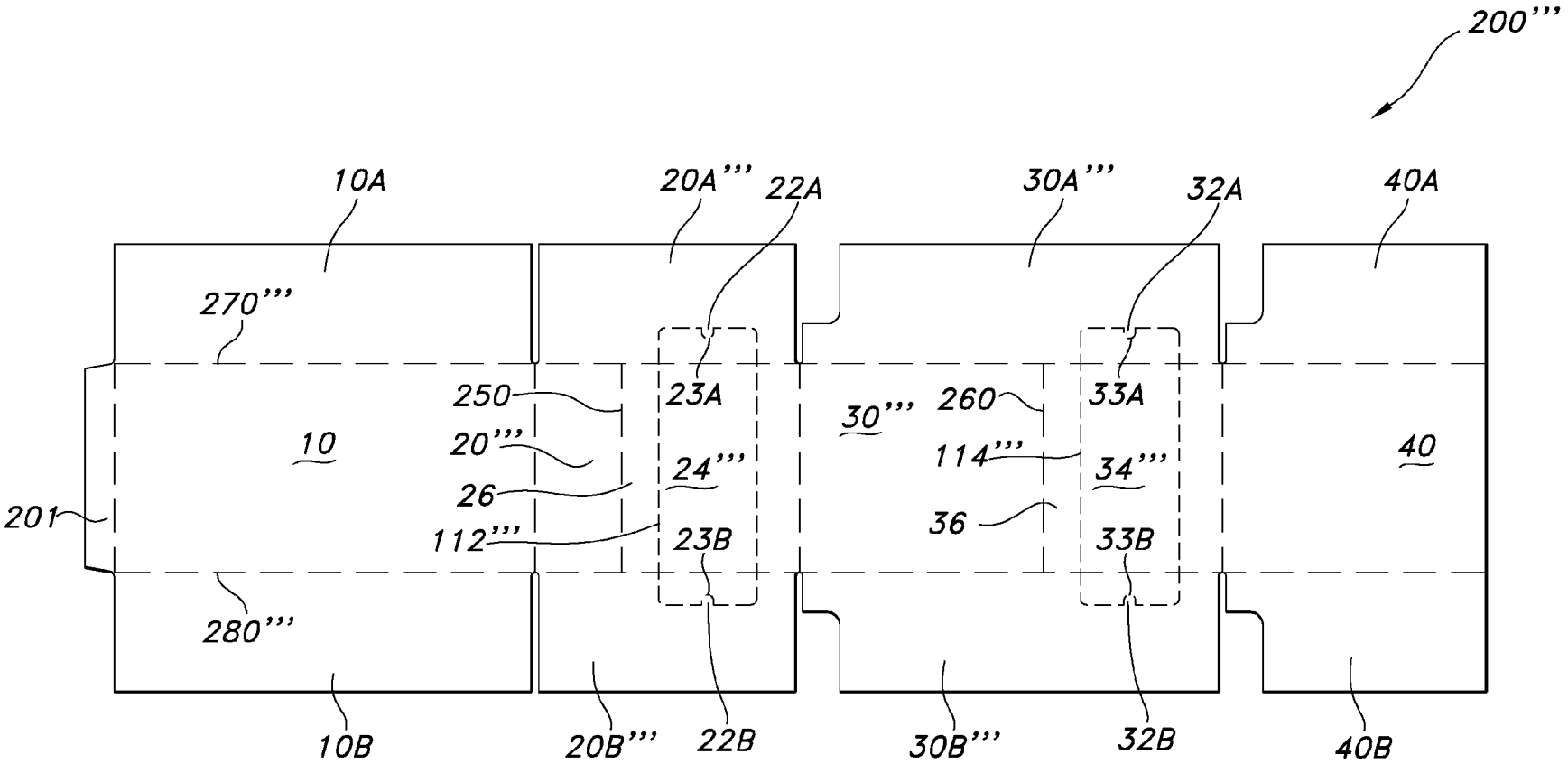
FIG. 11 is a plan view of a fourth paperboard blank that can be used to make the embodiment of the combination shipping container and dispenser shown in FIG. 12.

The paperboard blank 200''' that can be used to make combination shipping container and dispenser 100''' shown in FIGS. 12-15 is shown in FIG. 11. Paperboard blank 200''' is substantially similar to paperboard blank 200 illustrated in FIG. 6, except as discussed below. Paperboard blank 200''' includes a fifth vertical fold line 250 that extends between first horizontal fold line 270''' and second horizontal fold line 280'''. In addition, in order to ensure that end panel hinged door portion 26 can hinge about fifth vertical fold line 250, first horizontal fold line 270''' and second horizontal fold line 280''' are both perforated between fifth vertical fold line 250 and the left most portion of perforation 112''' so the portion of end panel hinged door portion 26 adjacent to first end panel top flap 20A''' and first end panel bottom flap 20B''' can be detached therefrom. Similarly, paperboard blank 200''' also includes a sixth vertical fold line 260 that extends between first horizontal fold line 270''' and second horizontal fold line 280'''. And, in order to ensure that top panel hinged door portion 36 can hinge about sixth vertical fold line 260, first horizontal fold line 270''' and second horizontal fold line 280''' are both perforated between sixth vertical fold line 260 and the left most portion of perforation 114''' so the portion of top panel hinged door portion 26 adjacent to top panel top flap 30A''' and top panel bottom flap 30B''' can be detached therefrom.

Figure 12:
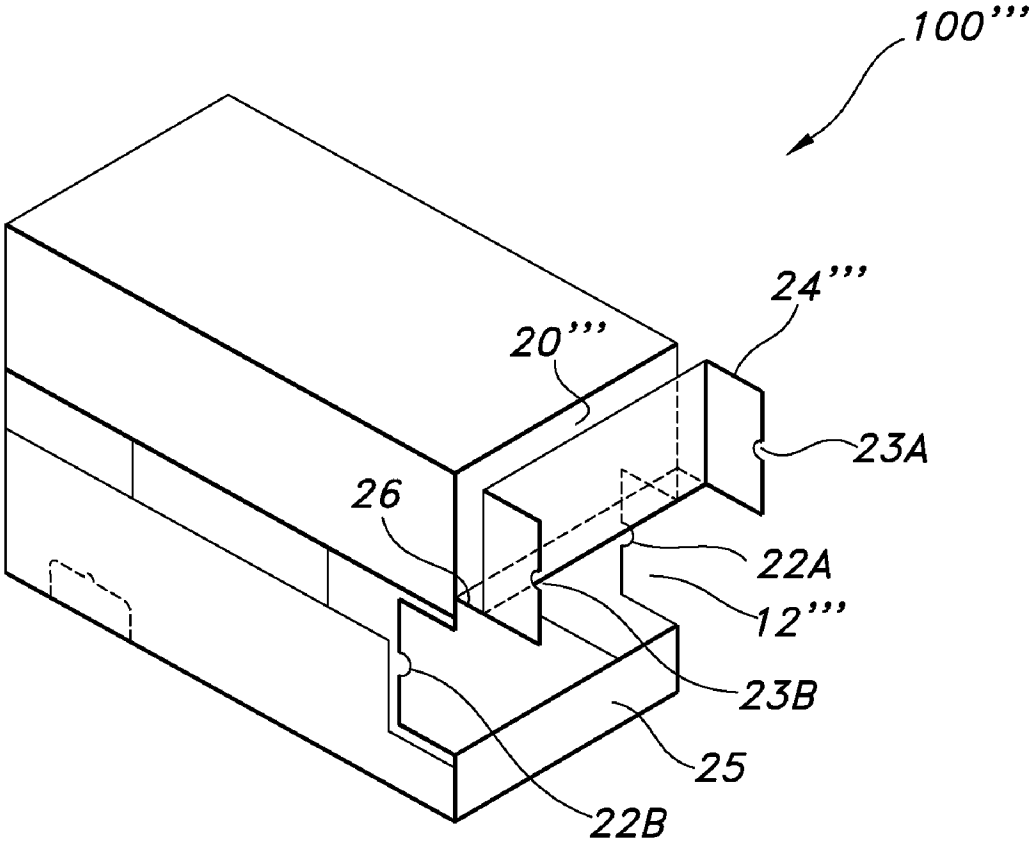
FIG. 12 is a perspective view of another embodiment of the combination shipping container and dispenser in a horizontal dispensing orientation with the dispenser opening in an end panel.
Figure 13:
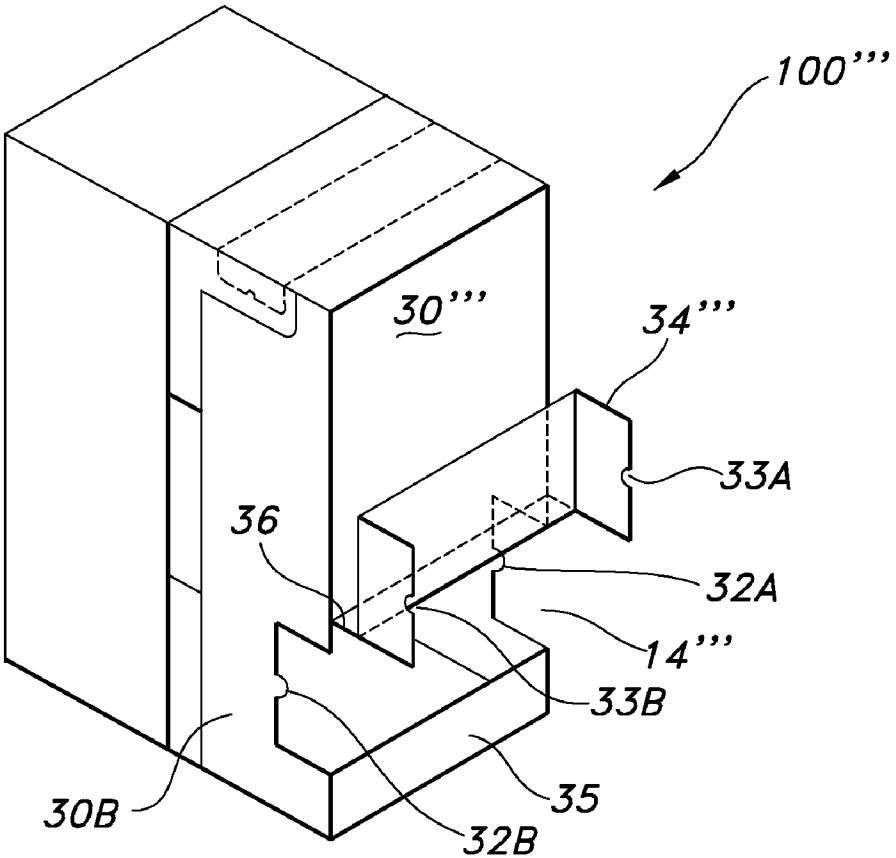
FIG. 13 is a perspective view of the combination shipping container and dispenser of FIG. 12 in a vertical dispensing orientation with the dispenser opening in the top panel.
Figure 14:
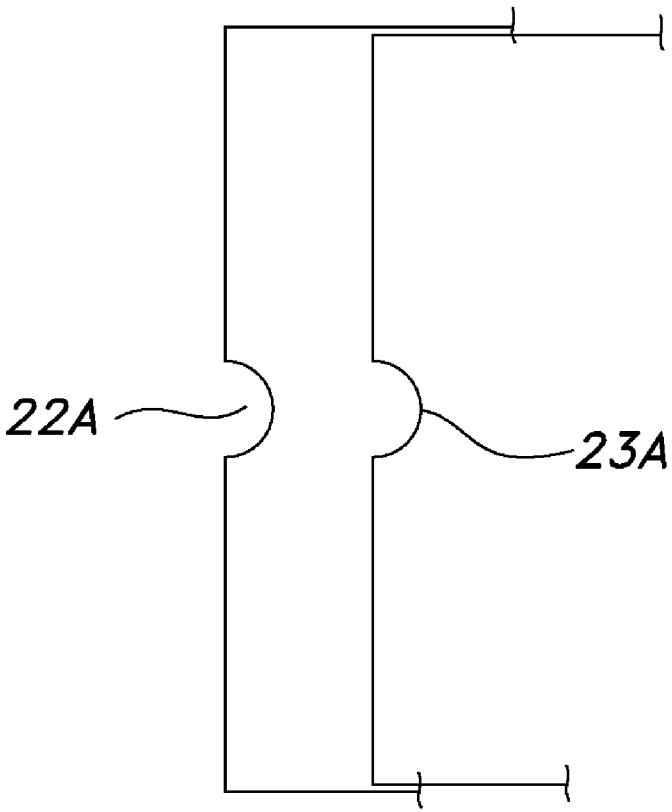
FIG. 14 is a close up schematic view of a first locking tab on the combination shipping container and dispenser of FIG. 12 and a first notch on the end panel door.
Figure 15B:
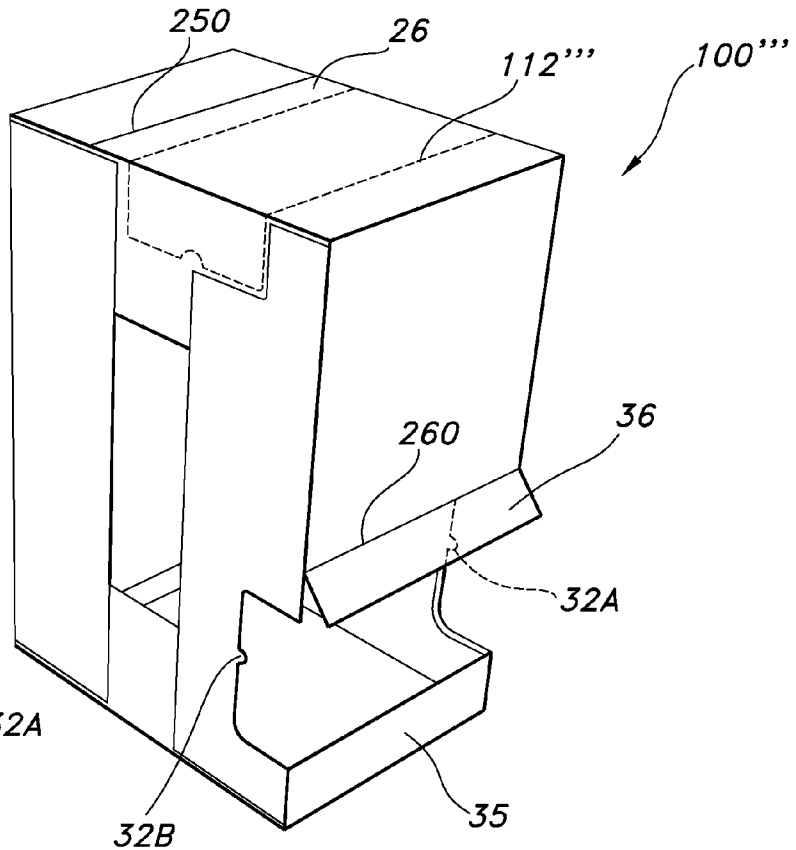
FIGS. 15A and 15B are perspective views of the combination shipping container and dispenser of FIG. 13 without the top panel door but which shows the top panel hinged door portion.
Figure 15A:
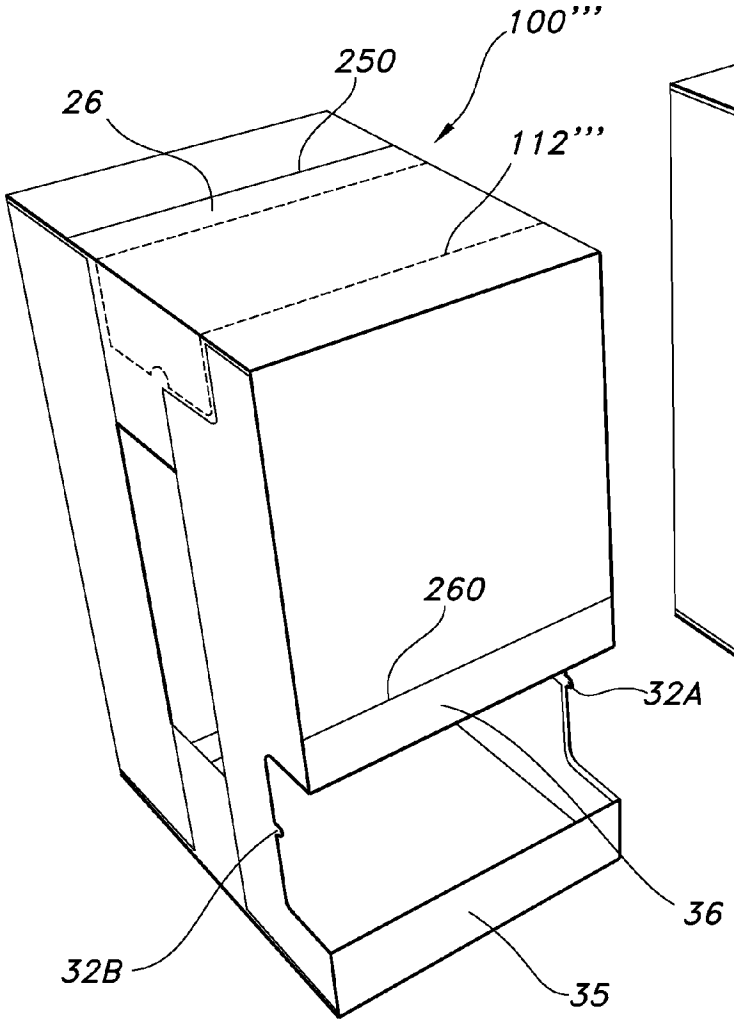

As shown in FIG. 12, end panel door 24 has been separated along a portion of perforation 112''' so that it is hinged along an upper portion of end panel dispenser opening 12'''. End panel door 24''' can be re-closed, if necessary, with end panel locking tabs 22A and 22B interlocking with corresponding notches 23A and 23B. See FIG. 14 as an example. As shown in FIG. 13, top panel door 34 has been separated along a portion of perforation 114''' so that it is hinged along an upper portion of top panel dispenser opening 14'''. Top panel door 34''' can be re-closed, if necessary, with top panel locking tabs 32A and 32B interlocking with corresponding notches 33A and 33B.

Figure 17:
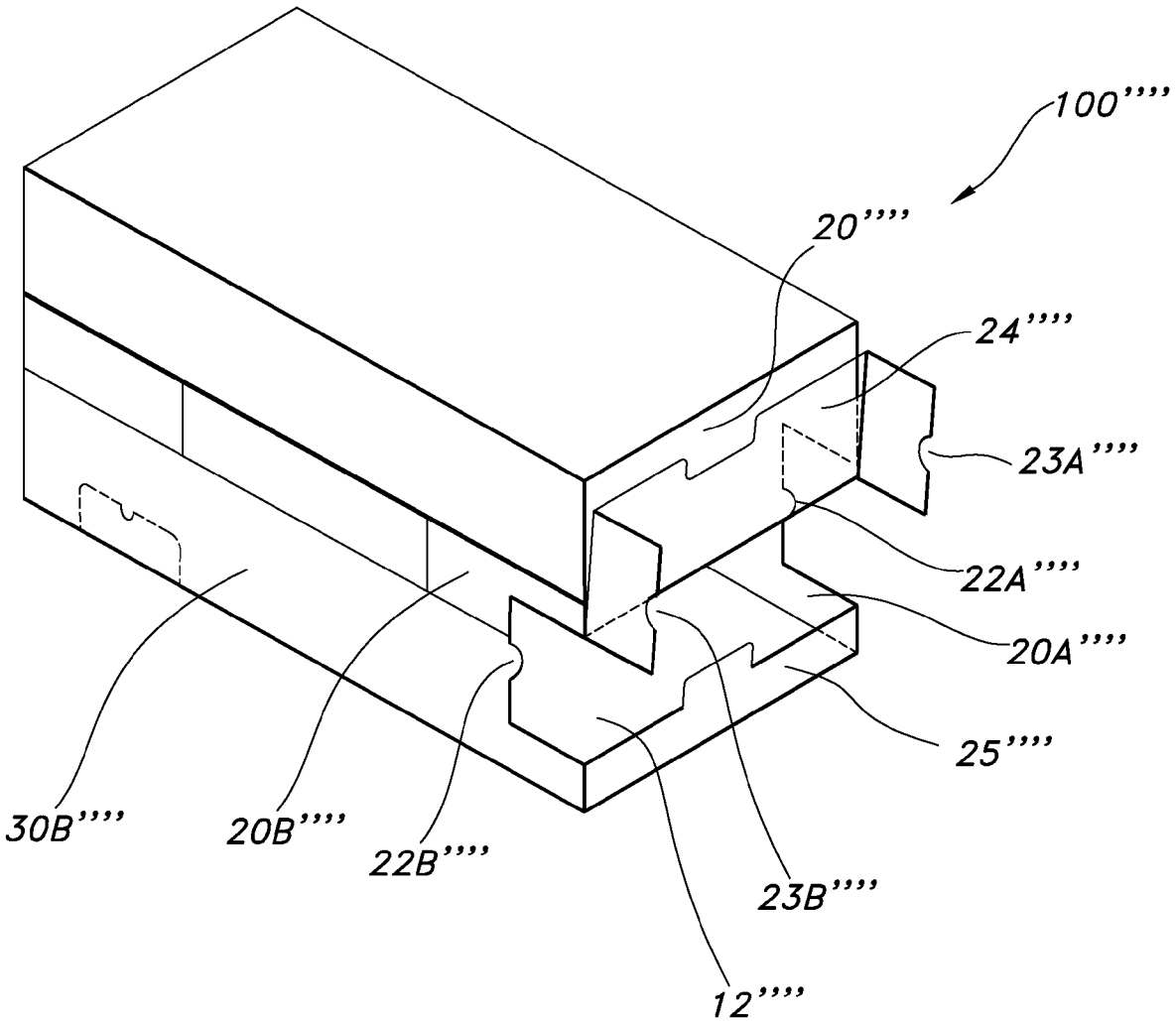
FIG. 17 is a perspective view of another embodiment of the combination shipping container and dispenser in the horizontal dispensing orientation with the dispenser opening in an end panel.
Figure 18:
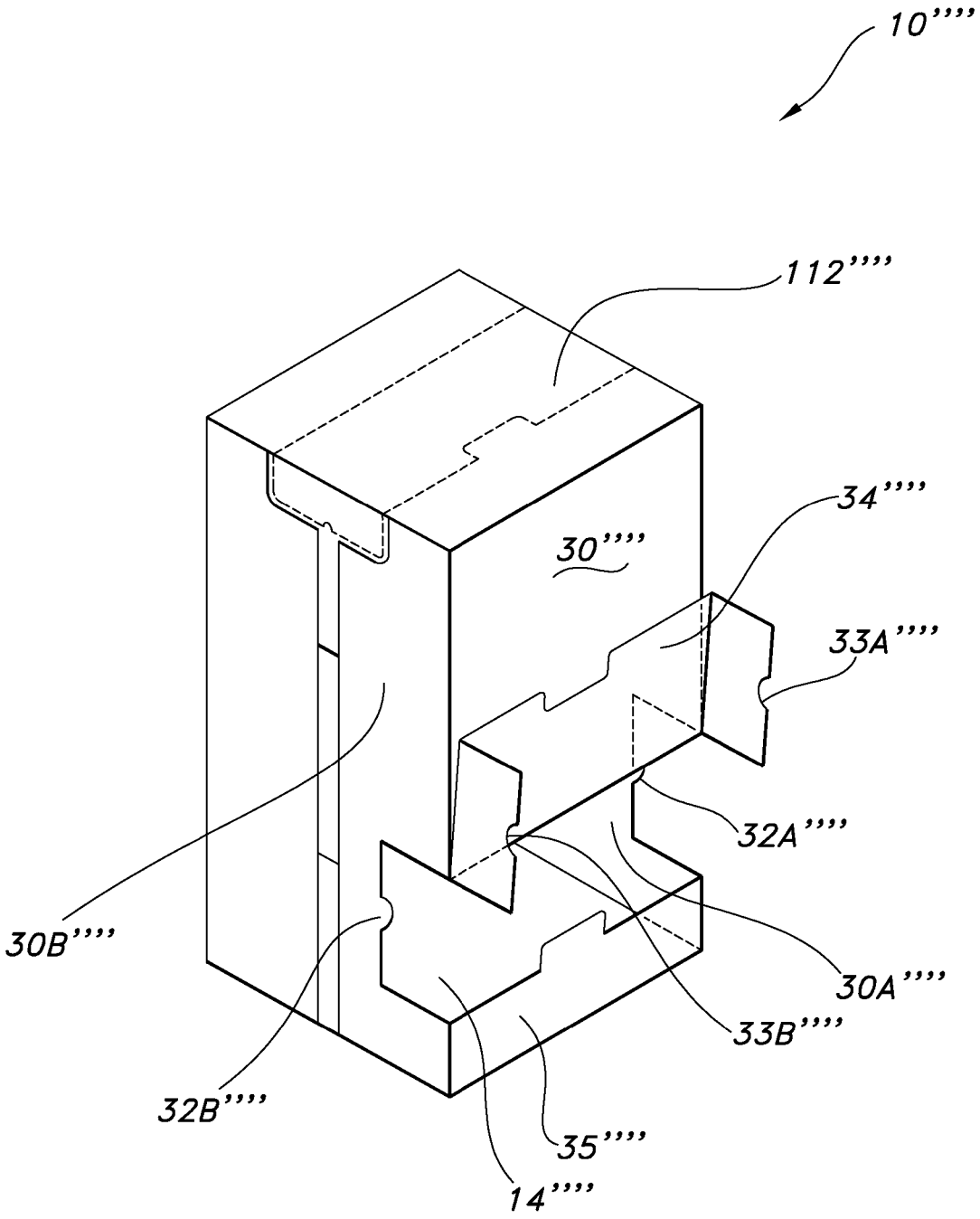
FIG. 18 is a perspective view of the combination shipping container and dispenser of FIG. 17 in the vertical dispensing orientation with the dispenser opening in the top panel.
Figure 19:
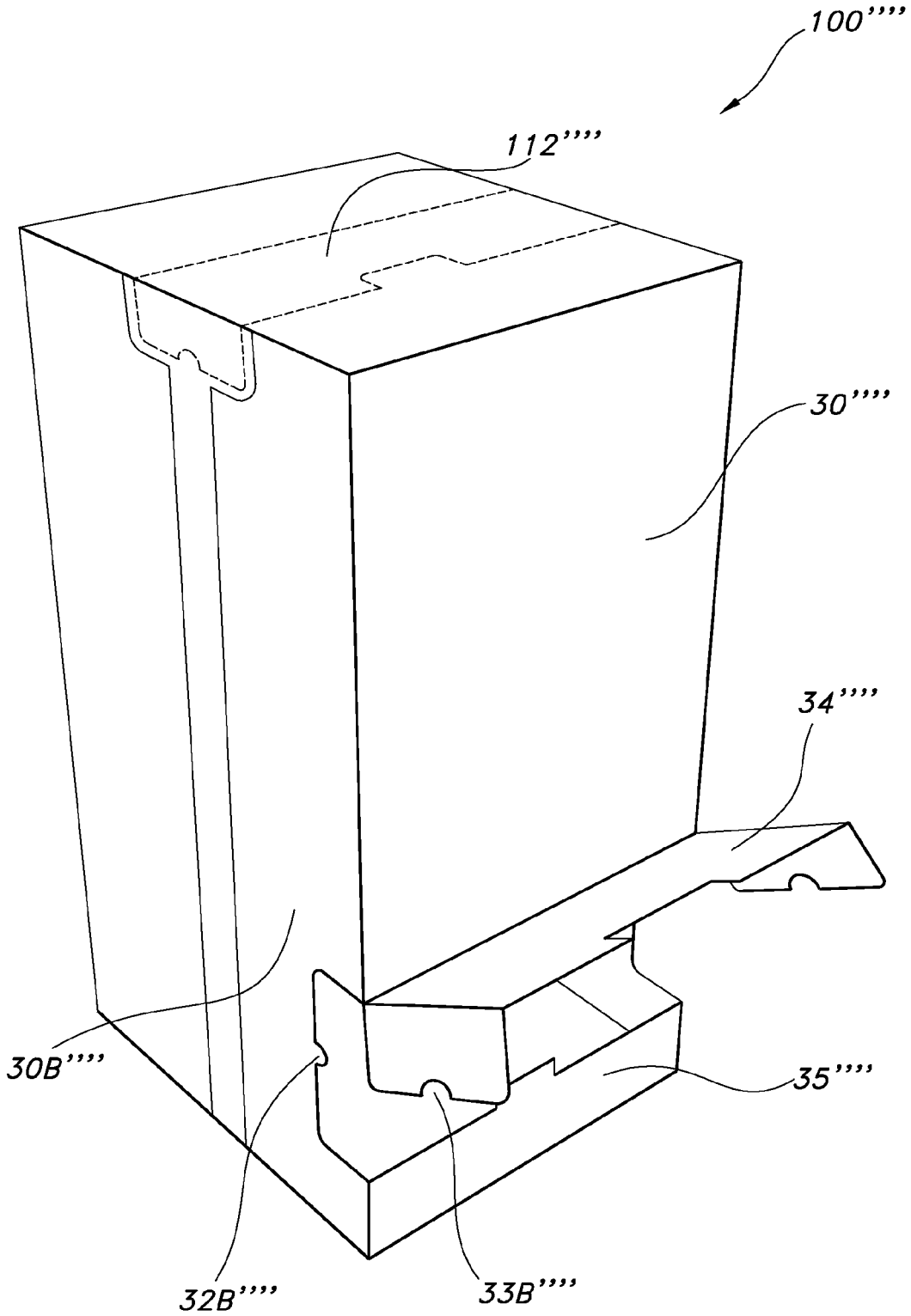
FIG. 19 is a perspective view of the combination shipping container and dispenser of FIG. 17 which further illustrates operation of the top panel door.

Another embodiment of the combination shipping container and dispenser of this invention having end panel door 24'''' and top panel door 34'''' does not include end panel hinged door portion 26 or top panel hinged door portion 36. See FIGS. 17-19. In this embodiment, end panel door 24'''' and top panel door 34'''' each have an access portion formed therein to facilitate the tearing of the paperboard material along perforations 112'''' and 114'''' to form end panel door 24'''' and top panel door 34'''' respectively. End panel locking tabs 22A'''', 22B'''' and top panel locking tabs 32A'''' and 32B'''' cooperate with notches 23A'''' and 23B'''' formed in end panel door 24'''' and notches 33A'''' and 33B'''' formed in top panel door 34'''' to hold end panel door 24'''' and top panel door 34'''' in place after they have been opened and then reclosed. By re-closing end panel door 24'''' and top panel door 34'''', the outside environment, such as dust, dirt or any other foreign materials, can be kept out of combination shipping container and dispenser 100''''. In addition, the perforations surrounding a portion of end panel locking tabs 22A'''', 22B'''' and top panel locking tabs 32A'''', 32B'''' allow the user to easily tear the paperboard material along perforations 112'''' and 114'''' to form end panel door 24'''' and top panel door 34''''. As shown in FIG. 17, end panel door 24'''' has been partially separated from the end panel 20'''' and completely separated from first end panel top flap 20A'''' and first end panel bottom flap 20B'''' and is hinged along an upper portion of end panel dispenser opening 12''''. End panel door 24'''' can be re-closed, if necessary, and held in the closed position by interlocking end locking tabs 22A'''', 22B'''' with the corresponding notches 23A'''', 23B''''. As shown in FIGS. 18 and 19, top panel door 34'''' has been partially separated from the top panel 30'''' and completely separated from top panel top flap 30A'''' and top panel bottom flap 30B'''' and is hinged along an upper portion of top panel dispenser opening 14''''. Top panel door 34'''' can be re-closed, if necessary, and held in the closed position by interlocking top panel locking tabs 32A'''', 32B'''' with the corresponding notches 33A'''', 33B''''.

Figure 16:
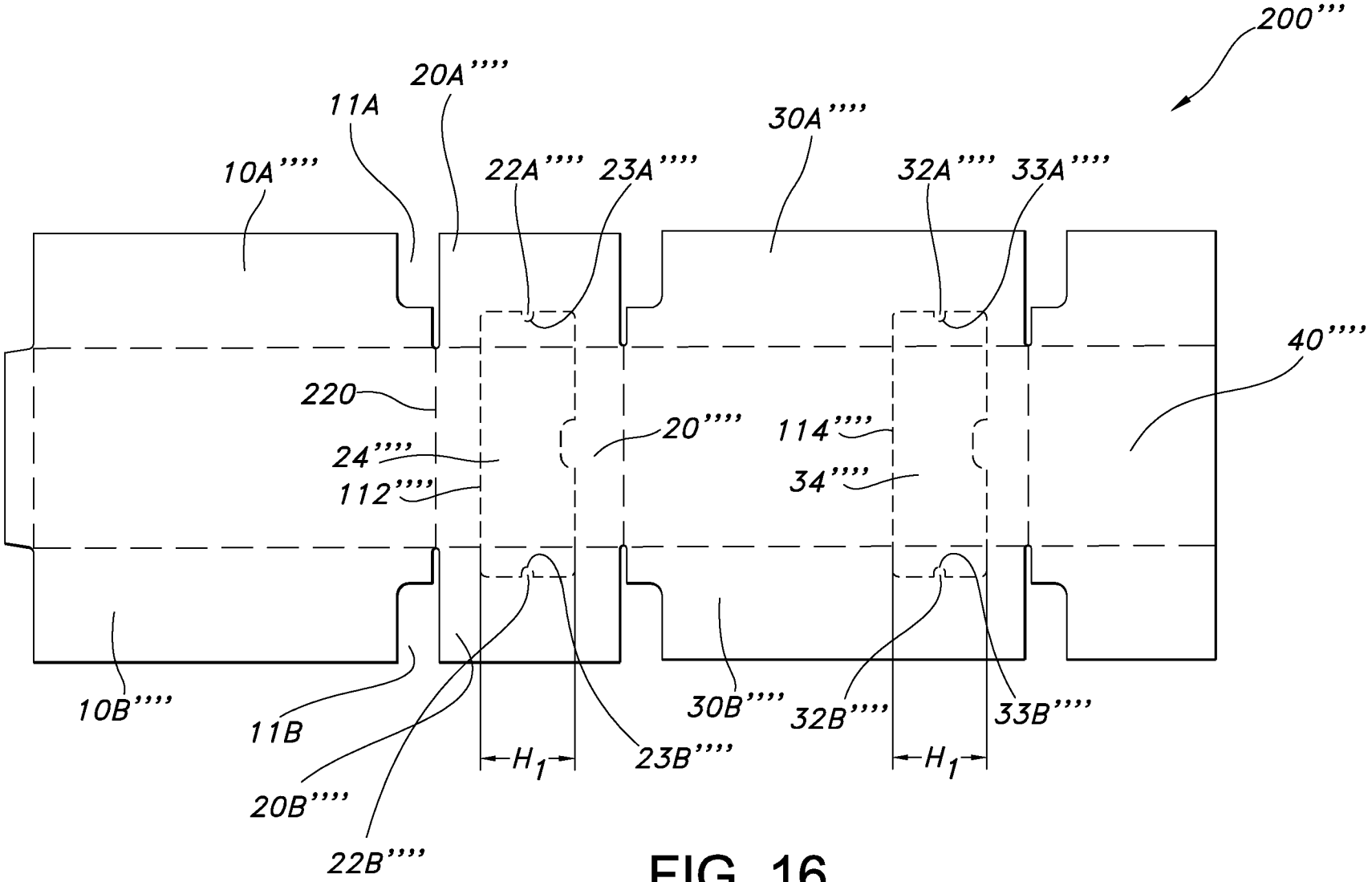
FIG. 16 is a plan view of a fifth paperboard blank that can be used to make the combination shipping container and dispenser of FIG. 17.

A fifth paperboard blank 200'''' can be used to make combination shipping container and dispenser 100'''' is shown in FIG. 16. Paperboard blank 200'''' is substantially similar to paperboard blank 200 shown in FIG. 6, except as discussed below. In order to allow end panel door 24'''' and top panel door 34"" to be hinged with respect to end panel 20"" and top panel 30"", respectively, perforations 112"" and 114"" do not extend between first horizontal fold line 270"" and second horizontal fold line 280"" along its leftmost side. Instead, a fold line is created along that portion. In addition, perforations 112"" and 114"" do not extend completely parallel to first horizontal fold line 270"" and second horizontal fold line 280"" along its top edge and bottom edge respectively. Instead, a generally semi-circular portion is included along the top edge and the bottom edge of each of perforations 112"" and 114"". These semi-circular portions create end panel locking tabs 22A"" and 22B"" and top panel locking tabs 32A"" and 32B"". In addition perforations 112"" and 114"" define a handle portion along the right side thereof. The handle portion also provides a place to facilitate the initiations of the tearing of perforations 112"" and 114"".

Fifth paperboard blank 200"" is designed to form a container 100"" that can ship and dispense twelve rolls of paper towels products. The first end panel 20"" and second end panel 40"" are not as wide as the end panels in the other embodiments. This requires notches 11A, 11B formed in bottom panel top flap 10A"" and bottom panel bottom flap 10B"" respectively so that bottom panel top flap 10A"" does not cover first wrap around portion and bottom panel bottom flap 10B"" does not cover second wrap around portion when container 100"" is assembled. The width of the notches should be about the same dimension as or slightly larger than the distance between second vertical fold line 220 and the right most portion of perforation 112"" The length of the notches should be about the same as height H1 or slightly larger.

The present invention has been described with reference to exemplary embodiments thereof. It will be readily apparent, however, to those skilled in the art that it is possible to embody the invention in specific forms other than those of the exemplary embodiments described above. This may be done without departing from the spirit of the invention. The exemplary embodiments are merely illustrative and should not be considered restrictive in any way.

What is claimed is:

1. A combination shipping container and dispenser, comprising:

a top;

a bottom opposite the top;

two end walls, each end wall being located between the top and the bottom;

two sides, each being located between the top and the bottom and adjacent to each of the end walls;

a first perforation formed in the top and extending to each of the sides and extending between a first point and a second point;

a first line of weakness extending between the first point and the second point of the first perforation, the first perforation and the first line of weakness defining a first opening in the combination shipping container and dispenser and a first hinged door for covering the first opening;

a second perforation formed in one of the end walls and extending to each of the sides and extending between a first point and a second point;

a second line of weakness extending between the first point and the second point of the second perforation, the second perforation and the second line of weakness defining a second opening in the combination shipping container and dispenser and a second hinged door for covering the second opening;

a third perforation extending from the first point of the first perforation generally perpendicular thereto and a fourth perforation extending from the second point of the first perforation generally perpendicular thereto and a third line of weakness generally parallel to the first line of weakness and extending between the third perforation and the fourth perforation, wherein a section of the top disposed between the first line of weakness and the third line of weakness defines a first hinged door portion coextensive with the first hinged door such that the first opening defined by pivotally opening the first hinged door about the first line of weakness is enlarged by pivotally opening the first hinged door portion about the third line of weakness; and a fifth perforation extending from the first point of the second perforation generally perpendicular thereto and a sixth perforation extending from the second point of the second perforation generally perpendicular thereto and a fourth line of weakness generally parallel to the second line of weakness and extending between the fifth perforation and the sixth perforation, wherein a section of the respective end wall disposed between the second line of weakness and the fourth line of weakness defines a second hinged door portion coextensive with the second hinged door such that the second opening defined by pivotally opening the second hinged door about the second line of weakness is enlarged by pivotally opening the second hinged door portion about the fourth line of weakness.

2. The combination shipping container and dispenser of claim 1 wherein the first hinged door is located in the top adjacent to the end wall that does not contain the second hinged door.

3. A blank for forming a combination shipping container and dispenser, comprising:

an adhesive tab;

a bottom panel adjacent to the adhesive tab and having a top and a bottom;

a first end panel adjacent to the bottom panel and having a top and a bottom;

a top panel adjacent to the first end panel and having a top and a bottom;

a second end panel adjacent to the top panel and having a top and a bottom;

a bottom panel top flap adjacent to the top of the bottom panel;

a bottom panel bottom flap adjacent to the bottom of the bottom panel;

a first end panel top flap adjacent to the top of the first end panel;

a first end panel bottom flap adjacent to the bottom of the first end panel;

a top panel top flap adjacent to the top of the top panel;

a top panel bottom flap adjacent to the bottom of the top panel;

a second end panel top flap adjacent to the top of the second end panel;

a second end panel bottom flap adjacent to the bottom of the second end panel;

a first perforation formed in the first end panel and extending partially into the first end panel top flap and the first end panel bottom flap, the first perforation extending between a first point and a second point;

a first line of weakness extending between the first point and the second point of the first perforation, the first perforation and the first line of weakness defining a first hinged door;

a second perforation formed in the top panel and extending partially into the top panel top flap and the top panel bottom flap, the second perforation extending between a first point and a second point;

a second line of weakness extending between the first point and the second point of the second perforation, the second perforation and the second line of weakness defining a second hinged door;

a third line of weakness substantially parallel to the first line of weakness and a third perforation extending between the first point of the first perforation and the third line of weakness and a fourth perforation extending between the first point of the first perforation and the third line of weakness, wherein a section of the first end panel disposed between the first line of weakness and the third line of weakness defines a first hinged door portion coextensive with the first hinged door such that a first opening defined by pivotally opening the first hinged door about the first line of weakness is enlarged by pivotally opening the first hinged door portion about the third line of weakness; and a fourth line of weakness substantially parallel to the second line of weakness and a fifth perforation extending between the first point of the second perforation and the fourth line of weakness and a sixth perforation extending between the second point of the second perforation and the fourth line of weakness, wherein a section of the top panel disposed between the second line of weakness and the fourth line of weakness defines a second hinged door portion coextensive with the second hinged door such that a second opening defined by pivotally opening the second hinged door about the second line of weakness is enlarged by pivotally opening the second hinged door portion about the fourth line of weakness.

* * * * *